US010024293B2

(12) United States Patent
Fujita et al.

(10) Patent No.: US 10,024,293 B2
(45) Date of Patent: Jul. 17, 2018

(54) SYSTEM FOR CONTROLLING TORQUE APPLIED TO ROTATING SHAFT OF ENGINE

(71) Applicant: DENSO CORPORATION, Kariya, Aichi-pref. (JP)

(72) Inventors: Tatsuya Fujita, Kariya (JP); Ryosuke Utaka, Kariya (JP); Mitsuhiro Murata, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/592,365

(22) Filed: May 11, 2017

(65) Prior Publication Data

US 2017/0328331 A1 Nov. 16, 2017

(30) Foreign Application Priority Data

May 11, 2016 (JP) ..... 2016-095630

(51) Int. Cl.

| | |
|---|---|
| ***F02N 11/08*** | (2006.01) |
| ***F02N 15/04*** | (2006.01) |
| ***F02D 41/06*** | (2006.01) |
| ***F02N 11/10*** | (2006.01) |
| *F02D 41/04* | (2006.01) |
| *F02N 11/00* | (2006.01) |
| *F02N 11/04* | (2006.01) |

(52) U.S. Cl.

CPC ..... *F02N 15/04* (2013.01); *F02D 41/062* (2013.01); *F02N 11/0848* (2013.01); *F02N 11/101* (2013.01); *F02D 41/042* (2013.01); *F02N 11/006* (2013.01); *F02N 11/04* (2013.01); *F02N 11/0844* (2013.01); *F02N 2200/041* (2013.01); *F02N 2200/102* (2013.01); *F02N 2250/04* (2013.01); *F02N 2300/102* (2013.01)

(58) Field of Classification Search

CPC .... F02N 15/04; F02N 11/0848; F02N 11/101; F02N 11/0844; F02N 11/006; F02N 11/04; F02N 2250/04; F02N 2200/041; F02N 2200/102; F02N 2300/102; F02N 2011/0896; F02D 41/062; F02D 41/042

USPC ..... 123/179.3, 179.4, 179.25, 179.28

See application file for complete search history.

(56) References Cited

U.S. PATENT DOCUMENTS 6,396,165 B1 5/2002 Nagano et al.

FOREIGN PATENT DOCUMENTS

JP 2007-246030 A 9/2007

*Primary Examiner* — Hai Huynh

(74) *Attorney, Agent, or Firm* — Oliff PLC

(57) ABSTRACT

In a system for controlling rotation of torque applied to a rotating shaft of an engine of a vehicle that uses the engine as a drive source thereof, a motor is provided. A main controller controls the engine and the motor. The main controller selectably activates the motor that applies first torque to the rotating shaft of the engine, and deactivates the motor. A rotary electric machine includes a rotor connected to the rotating shaft of the engine. A rotation parameter detector measures a rotation parameter associated with rotation of the rotor of the rotary electric machine. A sequence controller performs, in response to an occurrence of a trigger situation, a control sequence that controls, independently of the main controller, the rotary electric machine based on the rotation parameter measured by the rotation parameter detector, thus applying second torque to the rotating shaft of the engine.

18 Claims, 14 Drawing Sheets

SYSTEM FOR CONTROLLING TORQUE APPLIED TO ROTATING SHAFT OF ENGINE

CROSS REFERENCE TO RELATED APPLICATIONS

This application is based on and claims the benefit of priority from Japanese Patent Application 2016-095630 filed on May 11, 2016, the disclosure of which is incorporated in its entirety herein by reference.

TECHNICAL FIELD

The present disclosure relates to systems for controlling torque, i.e. rotational force, applied to the rotating shaft of an engine, i.e. an internal combustion engine.

BACKGROUND

Integrated starter generator (ISG) systems are widely used to apply torque to the rotating shaft of an engine at the startup of the engine.

An ISG system includes a motor-generator coupled to the rotating shaft of an engine via a belt, and causes the motor-generator as a starter to apply torque to the rotating shaft of the engine via the belt, thus starting, i.e. cranking, the engine. The ISG system also includes a starter motor, in addition to the motor-generator, for applying torque to the rotating shaft of the engine while the pinon of the starter motor is engaged with the ring gear of the rotating shaft of the engine at low temperatures. This is because the belt may be difficult to slide at the low temperatures, which may result in difficulty of smoothly applying torque to the rotating shaft of the engine via the belt.

The larger torque applied to the belt is, the higher strength and endurance of the belt need be. The larger toque applied to the belt may result in a belt tensioner provided for absorbing torque fluctuations.

In particular, Japanese Patent Publication No. 4421567, referred to as a published patent document, discloses such an ISG system, which includes both a motor-generator and a starter motor. The ISG system disclosed in the published patent document includes an electronic control system (ECU) that is programmed to cause the starter motor to apply a first torque to the rotating shaft of an engine until the occurrence of first firing, i.e. an initial ignition, in the engine. Thereafter, the ECU of the ISG system is programmed to cause the motor-generator to apply a second torque, which is lower than the first torque, to the rotating shaft of the engine until the engine is fired up in which the rotating shaft can be rotated by combustion operations of the engine itself. This enables the motor-generator to have relatively lower maximum output required to start the engine, thus reducing manufacturing cost of the ISG system.

SUMMARY

Such an ISG system, which includes both a motor-generator and a starter motor for cranking the rotating shaft of an engine, needs to individually control both the motor-generator and the starter motor at their proper timings while controlling them in cooperation with each other.

Unfortunately, the ECU of the ISG system disclosed in the published patent document needs to control, during the starting of the engine, proper fuel injection timings into the engine and proper ignition timings of fuel in the engine in addition to controlling the motor-generator and starter motor. During the starting of the engine, the ECU also needs to check whether various actuators installed in the engine are operating properly.

This may increase the processing load of the ECU during the starting of the engine, which may result in communication delay between the ECU and the motor-generator. The communication delay between the ECU and the motor-generator may cause the starting performance of the engine to deteriorate, such as the starting of the engine to be delayed.

In addition, there may be a large number of instructions of the software program installed in the ECU for causing the motor-generator to start the engine, resulting in a large number of software program calibration processes.

In view of the circumstances set forth above, one aspect of the present disclosure seeks to provide systems for controlling torque applied to the rotating shaft of an engine, each of which aims to solve the problems.

Specifically, an alternative aspect of the present disclosure aims to provide such control systems, each of which is capable of performing the torque control more efficiently than the above conventional systems. In particular, a further aspect of the present invention aims to provide such control systems, each of which is capable of having lower processing load of a main controller for controlling an engine of a vehicle.

According to a first structure of a first exemplary aspect of the present disclosure, there is provided a system for controlling rotation of torque applied to a rotating shaft of an engine of a vehicle that uses the engine as a drive source thereof. The system includes a motor, and a main controller for controlling the engine and the motor. The main controller is configured to selectably activate the motor that applies first torque to the rotating shaft of the engine, and deactivate the motor. The system includes a rotary electric machine comprising a rotor connected to the rotating shaft of the engine, and a rotation parameter detector configured to measure a rotation parameter associated with rotation of the rotor of the rotary electric machine. The system includes a sequence controller configured to perform, in response to an occurrence of a trigger situation, a predetermined control sequence that controls, independently of the main controller, the rotary electric machine based on the rotation parameter measured by the rotation parameter detector to thereby apply second torque to the rotating shaft of the engine.

The main controller has a lower processing load for simply activating or deactivating the motor. In contrast, if the main controller did control the rotary electric machine based on the rotating parameter, the main controller would have a higher processing load, because the main controller would need to send various commands based on the rotating parameter to the rotary electric machine.

From this viewpoint, the system according to the first stricter of the first exemplary aspect is configured such that the sequence controller perform, in response to an occurrence of a trigger situation, a predetermined control sequence that controls, independently of the main controller, the rotary electric machine based on the rotation parameter measured by the rotation parameter detector to thereby apply second torque to the rotating shaft of the engine. This eliminates the need for the sequence controller to communicate with the main controller that is required to control of the engine. This therefore reduces communications traffic between the main controller and the sequence controller even if the main controller has a high processing load. This prevents communication delay between the main controller and the sequence controller, thus maintaining the starting performance of the engine at a higher level. This also reduces the number of instructions of the software program installed in the main controller, resulting in a lower number of software program calibration processes.

Note that control sequences described in the specification each represent at least one predetermined control routine linked to a corresponding trigger situation; the at least one predetermined control routine that controls a corresponding target to be controlled. If a control sequence is comprised of a first control routine and a second control routine, the order of execution of the first and second control routines can be determined based on a corresponding trigger situation, or can be determined independently of a corresponding trigger situation.

In the system according to a second structure of the first exemplary aspect of the present disclosure, the motor is connectable to the rotating shaft of the engine via an engagement of first and second gears, and is configured to transfer the first torque to the rotating shaft of the engine while the first and second gears are engaged with each other. The rotary electric machine has a maximum rotational speed of the rotor higher than a maximum rotational speed of the motor. The rotary electric machine is configured to transfer the second torque to the rotating shaft via a belt mechanism.

Usual engine starting systems are each comprised of such a motor that transfers torque to the rotating shaft of an engine via an engagement of first and second gears, and such a rotary electric machine that transfers torque to the rotating shaft of the engine via a belt mechanism. Thus, applying the sequence controller to such a usual engine starting system enables the system according to the second structure of the first exemplary aspect to be constructed, resulting in reduction in constructing cost of the system.

In the system according to a third structure of the first exemplary aspect of the present disclosure, the control sequence includes a starting sequence that causes the rotary electric machine to apply the second torque to the rotating shaft during starting of the engine. The main controller is configured to maintain deactivation of the motor when a rotational speed of the rotating shaft is higher than a predetermined value. The sequence controller is configured to perform the starting sequence when the rotational speed of the rotating shaft is higher than the predetermined value. The main controller is configured to activate the motor when the rotational speed of the rotating shaft is equal to or lower than the predetermined value. The sequence controller is configured to perform the starting sequence when the rotational speed of the rotating shaft is equal to or lower than the predetermined value.

The motor is connected to the rotating shaft of the engine via the engagement of the first and second gears. For this reason, if the motor were activated to apply the first torque to the rotating shaft when the rotational speed of the rotating shaft is higher than the predetermined value, noise and wearing of the first and second gears, which is generated by engagement of the first and second gears, would be large. This would result in the motor starting the engine when the rotational speed of the rotating shaft sufficiently has fallen, resulting in the delay of staring the engine.

In contrast, the system according to the third structure of the first exemplary aspect is configured such that the sequence controller is configured to perform the starting sequence while the motor is deactivated when the rotational speed of the rotating shaft is higher than the predetermined value. This reduces noise and wearing of the first and second gears, which is generated by engagement of the first and second gears, while preventing the delay of starting the engine.

In the system according to a fourth structure of the first exemplary aspect of the present disclosure, the starting of the engine is restarting of the engine, and the main controller is configured to activate the motor when the rotational speed of the rotating shaft is equal to or lower than the predetermined value. The sequence controller is configured to perform the starting sequence when a predetermined period has elapsed since activation of the motor by the main controller.

The motor usually transfers torque to the rotating shaft of the engine via an engagement of first and second gears. If the rotary electric machine increased the rotational speed of the rotating shaft before the first and second gears were engaged with each other, noise and wearing of the first and second gears, which is generated by engagement of the first and second gears, would be large.

From this viewpoint, the system is configured such that the sequence controller is configured to perform the starting sequence when the predetermined period has elapsed since activation of the motor by the main controller. This configuration enables the rotary electric machine to apply the second torque to the rotating shaft of the engine while the first and second gears are engaged with each other. This therefore reduces noise and wearing of the first and second gears, which is generated by engagement of the first and second gears, while preventing the delay of starting the engine.

In the system according to a fifth structure of the first exemplary aspect of the present disclosure, the sequence controller is configured to (1) Terminate the starting sequence when the rotational speed of the rotating shaft has reached a predetermined threshold speed (2) Stop the starting sequence when the rotational speed of the rotating shaft has not reached the predetermined threshold speed for a predetermined first time since the start of the starting sequence.

This configuration of the fifth structure of the first exemplary aspect prevents the starting sequence from endlessly being performed.

In the system according to a sixth structure of the first exemplary aspect of the present disclosure, the main controller is configured to 1. Supply fuel to the engine 2. Set a first timing to supply the fuel to the engine when the engine has not started for a predetermined second time since the start of the starting sequence to be earlier than a second timing to supply the fuel to the engine when the engine has started for the predetermined second time since the start of the starting sequence.

When the engine has not started for the second time, the sixth structure makes earlier the supply of the fuel to the engine, thus improving the starting performance of the engine. Otherwise, when the engine has started for the second time, the sixth structure makes later the supply of the fuel to the engine, thus improving the emission performance of the vehicle.

In the system according to a seventh structure of the first exemplary aspect of the present disclosure, the main controller is configured to 1. Supply fuel to the engine 2. Set a first activation time for which the motor is activated when the engine has not started for a third predetermined time since the start of the starting sequence to be longer than a second activation time for which the motor is activated when the engine has started for the third predetermined time since the start of the starting sequence.

When the engine has not started for the third predetermined time since the start of the starting sequence, the rotational speed of the rotor of the rotary electric machine does not rise due to any factor. The seventh structure makes longer the activation time for which the motor is activated when the engine has not started for the third predetermined time since the start of the starting sequence. This reliably starts the engine even if the rotary electric machine is out of condition.

According to a first structure of a second exemplary aspect of the present disclosure, there is provided a system for controlling rotation of torque applied to a rotating shaft of an engine of a vehicle. The vehicle uses the engine as a drive source thereof, and is configured to stop supply of fuel to the engine during stop of the vehicle to thereby stop fuel combustion in the engine. The system includes a motor connectable to the rotating shaft of the engine via an engagement of first and second gears. The motor is configured to transfer the first torque to the rotating shaft of the engine while the first and second gears are engaged with each other. The system also includes a main controller for controlling the engine and the motor. The main controller is configured to selectably activate the motor that applies first torque to the rotating shaft of the engine while the first and second gears are engaged with each other. The system includes a rotary electric machine comprising a rotor connected to the rotating shaft of the engine via a belt mechanism. The rotary electric machine has a maximum rotational speed of the rotor higher than a maximum rotational speed of the motor. The system includes a rotation parameter detector configured to measure a rotation parameter associated with rotation of the rotor of the rotary electric machine. The system includes a driver for driving the rotary electric machine, and a sequence controller configured to perform, in response to an occurrence of a trigger situation, a control sequence after the stop of the supply of the fuel to the engine and before stop of rotation of the rotating shaft. The control sequence is configured to cause the driver to control, independently of the main controller, the rotary electric machine based on the rotation parameter measured by the rotation parameter detector to thereby apply second torque to the rotating shaft of the engine via the belt mechanism.

The vehicle is configured to stop supply of fuel to the engine during stop of the vehicle to thereby stop fuel combustion in the engine. This results in the rotational speed of the rotating shaft in a forward direction starting to fall immediately after the stop of the fuel supply. Immediately before the stop of the engine, the inertia energy of the engine may cause the rotating shaft to rotate in a reverse direction opposite to the forward direction. The larger the inertial energy is, the larger the rotation angle of the rotating shaft in the reverse direction is. The larger the rotation angle of the rotating shaft in the reverse direction is, the larger torque to start the engine whose rotation angle is in the reverse direction need be.

From this viewpoint, the sequence controller performs, in response to the occurrence of a trigger situation, the control sequence after the stop of the supply of the fuel to the engine and before stop of rotation of the rotating shaft. The control sequence causes the driver to control, independently of the main controller, the rotary electric machine based on the rotation parameter measured by the rotation parameter detector to thereby apply the second torque to the rotating shaft of the engine via the belt mechanism. This applied second torque to the rotating shaft reduces the rotational angle of the rotating shaft in the reverse direction. This results in lower torque to restart the engine, making it possible to improve restarting performance of the engine.

In the system according to a second structure of the second exemplary aspect of the present disclosure, the control sequence is configured to maintain a rotational speed of the rotor of the rotary electric machine at a predetermined speed, and to thereafter cause the driver to stop the rotary electric machine.

This second structure enables the rotational speed of the rotating shaft to become to the predetermined speed of the rotor of the rotary electric machine. Setting the predetermined speed to a sufficiently low value enables the inertia energy of the engine immediately before stop of the engine to be smaller, thus further reducing the rotational angle of the rotating shaft in the reverse direction.

In the system according to a third structure of the second exemplary aspect of the present disclosure, the control sequence is configured to gradually reduce a rotational speed of the rotor of the rotary electric machine to prevent abrupt decrease of the rotational speed of the rotor of the rotary electric machine.

The applied second torque to the rotating shaft prevents abrupt decrease of the rotational speed of the rotor of the rotary electric machine, thus preventing reverse rotation of the rotating shaft of the engine.

In the system according to a third structure of the second exemplary aspect of the present disclosure, the sequence controller is configured to 1. Perform, in response to the occurrence of a first trigger situation that is the trigger situation, a reverse-rotation reduction sequence that is the control sequence after the stop of the supply of the fuel to the engine and before stop of rotation of the rotating shaft 2. Perform, in response to an occurrence of a second trigger situation, a starting sequence that controls, independently of the main controller, the rotary electric machine based on the rotation parameter measured by the rotation parameter detector to thereby apply a value of the second torque to the rotating shaft of the engine during starting of the engine.

The main controller is configured to

1. Receive an engine start request input thereto while the sequence controller performs the reverse-rotation reduction sequence 2. Start to activate, in response to the engine start request, the motor when a rotational speed of the rotating shaft has decreased below a predetermined speed.

The main controller starts to activate, in response to the engine start request, the motor when the rotational speed of the rotating shaft has decreased below the predetermined speed. This reduces noise and wearing of the first and second gears, which is generated by engagement of the first and second gears.

In the system according to a fourth structure of the second exemplary aspect of the present disclosure, the sequence controller is configured to 1. Perform, in response to the occurrence of a first trigger situation that is the trigger situation, a reverse-rotation reduction sequence that is the control sequence after the stop of the supply of the fuel to the engine and before stop of rotation of the rotating shaft 2. Perform, in response to an occurrence of a second trigger situation, a starting sequence that controls, independently of the main controller, the rotary electric machine based on the rotation parameter measured by the rotation parameter detector to thereby apply a value of the second torque to the rotating shaft of the engine during starting of the engine.

The main controller is configured to set a first interval between start of activation of the motor and start of the starting sequence when receiving an engine start request input thereto while the sequence controller performs the reverse-rotation reduction sequence to be longer than a second interval.

The main controller is configured to set the second interval between start of activation of the motor and start of the starting sequence when receiving the engine start request input thereto while the sequence controller does not perform the reverse-rotation reduction sequence.

The higher the rotational speed of the rotating shaft, the larger noise and wearing of the first and second gears, which is generated by engagement of the first and second gears, is.

From this viewpoint, the main controller is configured to set the first interval between start of activation of the motor and start of the starting sequence when receiving an engine start request input thereto while the sequence controller performs the reverse-rotation reduction sequence to be longer than the second interval while the sequence controller does not perform the reverse-rotation reduction sequence.

This configuration enables the first and second gears to be reliably engaged with each other during the longer first interval, thus prevent the rotary electric machine from being activated before the first and second gears are engaged with each other, resulting in less noise and wear of the first and second gears, which is generated by engagement of the first and second gears, while preventing the delay of starting the engine.

In the system according to each of the first and second exemplary aspects of the present disclosure, the control sequence comprises a first control sequence having a predetermined first condition and a second control sequence having a predetermined second condition. The sequence controller is configured to 1. Perform, in response to the occurrence of the first condition as the trigger situation, the first control sequence 2. Stop control of the rotary electric machine for a predetermined period despite of the occurrence of the second condition as the trigger situation 3. Perform the second control sequence when the predetermined period has elapsed since the occurrence of the second condition.

If the first control sequence were sequentially switched to the second control sequence, the second control sequence would be influenced by the rotary electric machine that has been activated based on the first control sequence.

From this viewpoint, the system according to each of the first and second exemplary aspects of the present disclosure is configured to perform the second control sequence when the predetermined period has elapsed since the occurrence of the second condition after execution of the first control sequence. This prevents the second control sequence from being influenced by the rotary electric machine that has been activated based on the first control sequence.

In the system according to each of the first and second exemplary aspects of the present disclosure, the sequence controller is configured to 1. Generate, based on the rotational speed of the motor, a trigger signal as the occurrence of the trigger situation 2. Perform the control sequence in response to the generated trigger signal.

This eliminates the need for the sequence controller to communicate with the main controller to receive the trigger signal. This therefore enables the control sequence to be performed with higher startability of the engine.

In the system according to each of the first and second exemplary aspects of the present disclosure, the rotary electric machine is an alternating-current rotary electric machine. The rotation parameter detector is configured to measure, as the rotation parameter, at least one of the rotational speed of the rotor of the alternating-current rotary electric machine and a rotational angle of the rotor of the alternating-current rotary electric machine relative to a reference position in accordance with electromotive force induced in the rotary electric machine.

A usual rotational speed sensor for directly measuring the rotational speed or rotational angle of the rotating shaft of the engine has a characteristic that, the lower the rotational speed of the rotating shaft is, the lower the accuracy of measuring the rotational speed of the rotating shaft is. From this viewpoint, the rotation parameter detector is configured to measure, as the rotation parameter, at least one of the rotational speed of the rotor of the alternating-current rotary electric machine and the rotational angle of the rotor of the alternating-current rotary electric machine relative to the reference position in accordance with electromotive force induced in the rotary electric machine.

This configuration measures, based on the electromotive force induced in the rotary electric machine, at least one of the at least one of the rotational speed of the rotor of the alternating-current rotary electric machine and the rotational angle of the rotor of the alternating-current rotary electric machine relative to the reference position without directly measuring rotation of the rotating shaft. This enables at least one of the rotational speed of the rotor of the alternating-current rotary electric machine and the rotational angle of the rotor with higher accuracy.

BRIEF DESCRIPTION OF THE DRAWINGS

Other aspects of the present disclosure will become apparent from the following description of embodiments with reference to the accompanying drawings in which.

DETAILED DESCRIPTION OF EMBODIMENT

Figure 1:
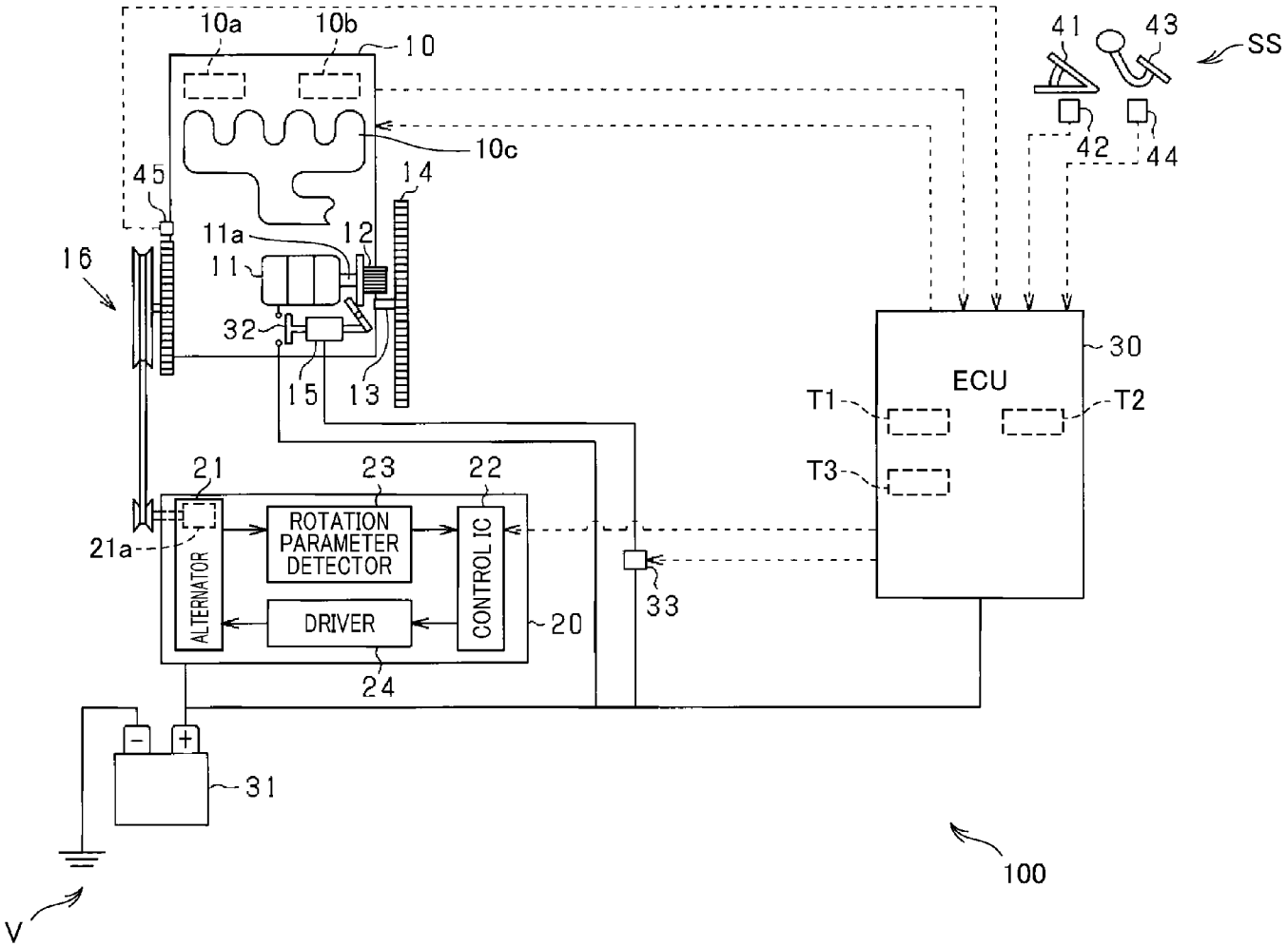
FIG. 1 is a circuit diagram schematically illustrating an overall structure of a control system according to the first embodiment of the present disclosure.

The following describes embodiments of the present disclosure with reference to the accompanying drawings. In the embodiments, like parts between the embodiments, to which like reference characters are assigned, are omitted or simplified to avoid redundant description.

First Embodiment

The following describes the first embodiment of the present disclosure. An engine starting system 100 according to the first embodiment is installed in a vehicle V that is equipped with an internal combustion engine, i.e. an engine 10.

Specifically, the engine 10, which is designed as a multicylinder engine, includes a rotating shaft, such as a crankshaft, 13 having opposing first and second ends. The engine 10 is operative to compress air-fuel mixture or air by the piston within each cylinder 10C and burn the compressed air-fuel mixture or the mixture of the compressed air and fuel within each cylinder 10C. This reciprocates a piston in each cylinder 10C through a top dead center (TDC) of the cylinder 10C to thereby rotate the rotating shaft 13 in a forward direction. This changes the energy of the combustion to rotational energy of the crankshaft 13, thus generating torque of the rotating shaft 13 based on the mechanical energy. Note that the forward direction of rotation of the rotating shaft 13 represents the rotational direction of the rotating shaft 13 when the vehicle V goes forward.

Referring to FIG. 1, the engine 10 includes a fuel injection system 10*a* and an ignition system 10*b*.

The fuel injection system 10*a* includes actuators, such as fuel injectors and igniters provided for the respective cylinders 10C, and causes the actuators to spray fuel either directly into each cylinder 10C of the engine 10 or into an intake manifold (or intake port) just ahead of each cylinder 10C thereof to thereby burn the air-fuel mixture in each cylinder 10C of the engine 10.

The ignition system 10*b* includes actuators, such as igniters, and causes the actuators to provide an electric current or spark to ignite an air-fuel mixture in each cylinder 10C of the engine 10, thus burning the air-fuel mixture.

The engine 10 includes a starter motor 11 as an example of rotary electric machines. The starter motor 11 has a rotating shaft 11*a* having opposing first and second ends. The starter motor 11 includes a drive unit coupled to the first end of the rotating shaft 11*a*. The drive unit of the starter motor 11 is capable of turning the rotating shaft 11*a*.

The starter motor 11 also includes a solenoid mechanism 15 including a solenoid; the solenoid mechanism 15 reciprocably shifts the rotating shaft 11*a* in its axial direction. To the second end of the rotating shaft 11*a*, a pinion 12 is mounted. To the first end of the rotating shaft 13, a ring gear 14 is mounted. The starter motor 11 is arranged to face the ring gear 14 such that the shifting operation of the rotating shaft 11*a* to the ring gear 14 by the solenoid mechanism 15 enables the pinon 12 to be engaged with the ring gear 14. This engagement of the pinion 12 with the ring gear 14 enables torque, i.e. positive torque, of the starter motor 11 to be transferred to the rotating shaft 13 of the engine 10.

The engine starting system 100 includes a motor-generator apparatus 20 as an example of rotary electric machines. The engine 10 includes a power transfer mechanism 16 comprised of, for example, a pulley and a belt. The power transfer mechanism 16 is operative to transfer torque, i.e. rotary power, of the rotating shaft 13 of the engine 10 to the motor-generator apparatus 20.

The motor-generator apparatus 20 serves as an alternator, i.e. a power generator, that converts the torque of the rotating shaft 13 of the engine 10 transferred from the engine 10 into electrical power. The motor-generator apparatus 20 also serves as a motor that supplies rotational power, i.e. torque, to the rotating shaft 13 of the engine 10 via the power transfer mechanism 16.

The motor-generator apparatus 20 includes an alternator 21, a control integrated circuit (IC), which serves as, for example a sequence controller, 22, a rotation parameter detector 23, and a driver 24.

The alternator 21 is designed as, for example, a three-phase alternating-current (AC) rotary electric machine comprised of, for example, a stator, a rotor 21*a*, a rotor coil, and the like. The stator includes, for example, a stator core and three-phase stator coils. The rotor 21*a* is coupled to an output shaft to which the power transfer mechanism 16 is coupled, and is configured to be rotatable relative to the stator core together with the output shaft. The three-phase stator coils are wound in, for example, slots of the stator core and around the stator core. The rotor coil is wound around the rotor 21*a* and is operative to generate a magnetic field in the rotor 21*a* when energized.

That is, the alternator 21 is capable of operating in a motor mode to rotate the rotor 21*a* based on magnetic interactions between the magnetic field generated in the rotor 21*a* and a rotating magnetic field generated by the three-phase stator coils. This enables the rotating shaft 13 of the engine 10 to rotate via the power transfer mechanism 16. In other words, the alternator 21 supplies torque to the rotating shaft 13 of the engine 10 via the power transfer mechanism 16, thus rotating the rotating shaft 13 of the engine 10.

In addition, the alternator 21 is capable of operating in a generator mode to generate electrical power in the stator coils based on electromotive force induced by rotation of the rotor 21*a*; the rotation of the rotor 21*a* is based on rotation of the rotating shaft 13 of the engine 10 via the power transfer mechanism 16.

For example, the alternator 21 has a maximum rotational speed of the rotor 21*a* higher than a maximum rotational speed of the starter motor 11.

The driver 24 includes a known inverter circuit including a plurality of switching elements, such as MOSFETs connected in, for example bridge configuration. The driver 24 is connected between the alternator 21 and a battery 31, which is an example of direct-current (DC) power sources.

The driver 24 has a first function of converting DC power supplied from the battery 31 into alternating-current (AC) power, thus applying the AC power to the three-phase stator coils.

The driver 24 also has a second function of converting AC power supplied from the alternator 21 into DC power, and supplying the DC power to the battery 21.

The rotation parameter detector 23 is operative to measure at least one parameter associated with rotation of the rotor 21*a* of the alternator 21.

Specifically, the rotation parameter detector 23 is operative to measure currents, i.e. three-phase currents, flowing through the respective three-phase stator coils when the alternator 21 is operating as the motor, and output the three-phase currents to the control IC 22. The rotation parameter detector 23 is also operative to measure the electromotive force induced in the alternator 21 when the alternator 21 is operating as the power generator, and output the induced electromotive force to the control IC 22.

The control IC 22 serves as a controller for controlling the alternator 21.

Specifically, when operating the alternator 21 in the motor mode, the control IC 22 controls the driver 24 to convert the DC power supplied from the battery 31 into three-phase AC power, thus applying the three-phase AC power to the three-phase stator coils of the alternator 21. This enables the three-phase stator coils to generate the rotating magnetic field set forth above, thus rotating the rotor 21*a*. In particular, the control IC 22 controls, based on the three-phase currents measured by the rotation parameter detector 23, on-off switching operations of the switching elements of the driver 24 such that the rotational speed of the rotor 21*a* follows a predetermined target rotational speed.

In addition, when operating the alternator 21 in the generator mode, the control IC 22 obtains the induced electromotive force measured by the rotation parameter detector 23. This enables the control IC 22 to obtain the rotational speed of the rotor 21*a*, i.e. the alternator 21, because the frequency of the induced electromotive force depends on the rotational speed, i.e. the number of rotations of the rotor 21*a* per unit time, of the alternator 21.

The rotation parameter detector 23 is also capable of measuring back-electromotive force in the alternator 21 when the alternator 21 is operating in the motor mode. That is, the rotation parameter detector 23 is capable of measuring the rotational angle of the rotor 21*a*, i.e. the alternator 21, relative to a predetermined position based on the measured induced electromotive force or the measured back-electromotive force.

That is, the rotation parameter detector 23 is capable of measuring electromotive force, i.e. a voltage or a current, induced in the alternator 21 when the rotor 21*a* of the alternator 21 is rotating. That is, the rotation parameter detector 23 is capable of measuring the rotational angle of the rotor 21*a*, i.e. the alternator 21, relative to a predetermined position based on the measured induced voltage or induced current.

The control IC 22 is therefore capable of (1) Determining whether the alternator 21 is operating based on the induced voltage or induced current detected by the rotation parameter detector 23

(2) The phase of one of the three-phase coils to which the driver 14 should energize, i.e. should supply an AC current based on the induced voltage or induced current detected by the rotation parameter detector 23.

The rotation parameter detector 23 or the control IC 22 is capable of calculating the rotational speed Ne of the rotating shaft 13 of the engine 10 based on the rotational speed of the rotor 21*a*, i.e. the alternator 21, and a predetermined speed reduction ratio of the power transfer mechanism 16. The rotational speed Ne of the rotating shaft 13 of the engine 10 will be referred to simply as an engine rotational speed Ne hereinafter. Note that the rotational speed of the alternator 21 is higher by the speed reduction ratio of the power transfer mechanism 16 than the rotational speed Ne of the rotating shaft 13.

The rotating shaft 13 of the engine 10 is coupled to a driving axle having at both ends driving wheels via a clutch and a gear mechanism, such as a transmission. Because these components of the driving axle, driving wheels, clutch and gear mechanism of the vehicle V are well known components, the specific descriptions of these components are omitted.

The engine starting system 100 also includes an electronic control unit (ECU) 30, which serves as, for example, a main controller, for performing overall control of the engine starting system 100. The ECU 30 is a well-known electronic control unit comprised of a microcomputer and a memory unit. The ECU 30 is operative to control the engine 10 based on measurement values measured by various sensors SS installed in the vehicle V.

The ECU 30 is electrically connected to the battery 31, and operates based on DC power supplied from the battery 31. The battery 31 is also electrically connected to the starter motor 11 via a switch 32, and is electrically connected to the solenoid of the solenoid mechanism 15 via a relay 33. The relay 33 is controllably connected to the ECU 30. That is, the ECU 30 controls the relay 33 to open or close the relay 33. The switch 32 is linked to the pinion 12 such that the shifting operation of the pinion 12 to or from the ring gear 14 enables the solenoid mechanism 15 to turn on or off the switch 32.

Specifically, the ECU 30 turns on the relay 33 to thereby energize the solenoid of the solenoid mechanism 15 based on the DC power supplied from the battery 31. This causes the solenoid mechanism 15 to shift the pinion 12 from a predetermined initial position to the ring gear 14 so that the pinion 12 is engaged with the ring gear 14. The shifting operation of the pinion 12 to the ring gear 14 causes the switch 32 to be turned on, resulting in the starter motor 11 being activated based on the DC power supplied from the battery 31. Because the pinion 12 is meshed with the ring gear 14, the starter motor 11 starts turning the rotating shaft 13 of the engine 10, thus starting cranking of the engine 10.

For example, when the rotational speed of the rotating shaft 13 has reached a predetermined rotational speed, the ECU 30 turns off the relay 33 to thereby deenergize the solenoid of the solenoid mechanism 15. This interrupts the DC power supply from the battery 31 to the solenoid of the solenoid mechanism 16, causing the solenoid mechanism 16 to shift the pinion 12 away from the ring gear 14 to the predetermined initial position. This results in the pinion 12 being disengaged from the ring gear 14.

The shifting operation of the pinion 12 away from the ring gear 14 to the predetermined initial position causes the switch 32 to be turned off, resulting in the starter motor 11 being deactivated.

In addition, the engine starting system 100 includes various sensors SS including, for example, an accelerator sensor 42, a brake sensor 44, and a rotational speed sensor 45.

The accelerator sensor 42 is operative to repeatedly measure the actual position or stroke of an accelerator pedal, which is an example of an accelerator operating member 41, operable by a driver of the vehicle V, and repeatedly output, to the ECU 30, a measurement signal indicative of the measured actual stroke or position of the accelerator pedal 41.

The brake sensor 44 is operative to repeatedly measure the actual position or stroke of a brake pedal 43 operable by a driver of the vehicle V, and repeatedly output, to the ECU 30, a measurement signal indicative of the measured actual stroke or position of the brake pedal 43.

The rotational speed sensor 45 is operative to repeatedly measure the rotational speed of the rotating shaft 13 of the engine 10, and repeatedly output, to the ECU 30, a measurement signal indicative of the measured rotational speed of the rotating shaft 13 of the engine 10.

The ECU 30 is designed as, for example, a typical microcomputer circuit comprised of, for example, a CPU, a storage medium including a ROM and a RAM, and an input/output (I/O).

The ECU 30 receives the measurement signals output from the sensors SS, and determines the operating conditions of the engine 10.

Then, the ECU 30 performs, in accordance with one or more control programs, i.e. routines, stored in the storage medium, various tasks for controlling the engine 10 using (1) The determined operating conditions of the engine 10

(2) Various pieces of data stored in the storage medium.

For example, the various tasks include a combustion task T1 (see FIG. 1) including a fuel injection control task and an ignition timing control task.

The fuel injection control task is designed to adjust the fuel injection timing for each cylinder 10C to a proper timing, and controls the fuel injection system 10*a* to adjust the injection quantity for the fuel injector for each cylinder 10C to a suitable quantity. Then, the fuel injection control task is designed to cause the fuel injection system 10*a* to spray the suitable injection quantity of fuel into a sequentially selected cylinder or the intake manifold of the engine 10 at the proper fuel injection timing.

The ignition timing control task is designed to control the ignition system 10*b* to adjust the ignition timing of each igniter for igniting the compressed air-fuel mixture or the mixture of the compressed air and fuel in a corresponding one of the cylinders 10C at a proper timing. The ignition timing for each cylinder 10C is represented as, for example, a crank angle of the rotating shaft 13 for the corresponding cylinder 10C with respect to the top dead center (TDC) of the corresponding cylinder 10C.

The control IC 22 includes a set of sequential control instructions, i.e. a control sequence, which serves as an engine starting task that applies torque to the rotating shaft 13 of the engine 10 while the engine 10 is stopped. The set of sequential control instructions serving as the engine starting task will be referred to as an engine starting sequence. The control IC 22 is configured to perform the engine starting sequence in cooperation with the starter motor 11. For example, the control IC 22 is configured to start the engine starting sequence in response to receiving a drive start command sent from the ECU 30 as a trigger signal.

Figure 2:
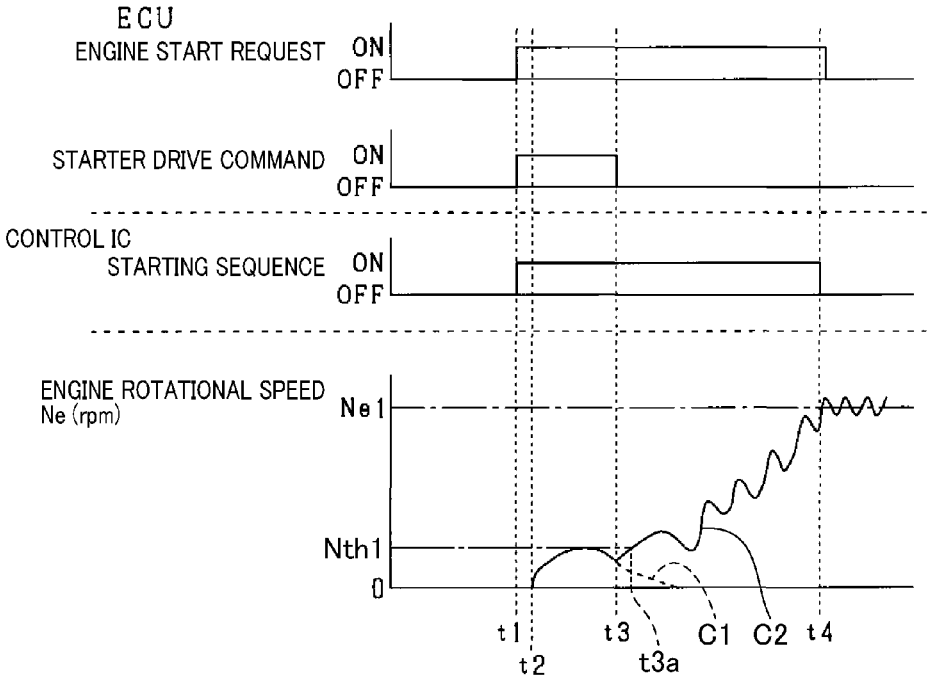
FIG. 2 is a timing chart schematically illustrating an engine starting process carried out by an ECU and a control IC according to the first embodiment.

The following describes how the ECU 30 and the control IC 22 operate for starting the engine 10 with reference to FIG. 2. Note that the following describes a case where the ECU 30 and control IC 22 operate for restarting the engine 10 when the driver has an intention to restart the engine 10 being shut down in an idle reduction state, i.e. an idle stop state. The ECU 30 and control IC 22 can operate for initially starting the engine 10 being stopped.

Referring to FIG. 2, a driver of the vehicle V inputs a predetermined request, i.e. an engine start request, for starting the engine 10 to the ECU 30 at time t1. For example, the measurement signal indicative of the driver's depression of the brake pedal 43 is sent from the brake sensor 44 to the ECU 30 at the time t1. In response to the engine start request, the ECU 30 generates a starter-motor drive command, i.e. turns on the starter-motor drive command, at the time t1, thus turning on the relay 33. This causes the solenoid mechanism 15 to shift the pinion 12 from the predetermined initial position to the ring gear 14 so that the pinion 12 is engaged with the ring gear 14.

At the time t1, the ECU 30 sends, as a trigger signal, an alternator drive command to the control IC 22 in response to the engine start request. The ECU 30 can send the engine start request to the control IC 22 as the alternator drive command When receiving the alternator drive command as the trigger signal at the time t1, the control IC 22 starts the engine starting sequence including the engine starting sequence at the time t1. Specifically, the control IC 22 causes the driver 24 to apply the three-phase AC power to the three-phase stator coils, thus generating the rotating magnetic field. The rotating magnetic field rotates the rotor 21*a*, that is, generates torque of the rotor 21*a*, based on the interactions with respect to the magnetic field generated in the rotor 21*a*. The generated torque is transferred from the alternator 21 to the rotating shaft 13 of the engine 10 through the power transfer mechanism 16.

On the other hand, the shifting operation of the pinion 12 to the ring gear 14 causes the switch 32 to be turned on at time t2. This starts DC power being supplied to the starter motor 11. The interval between the time t1 and the time t2, that is, the time from turn-on of the relay 33 to turn-on of the switch 32 is predetermined based on time required for the pinion 12 and ring gear 14 to be engaged with each other. When the starter motor 11 is activated based on the supplied DC power, rotational power of the starter motor 11 is transferred to the rotating shaft 13 of the engine 10. This results in the engine rotational speed Ne starting to rise.

When a predetermined first threshold time has elapsed since the time t1, the ECU 30 stops sending of the starter-motor drive command, i.e. turns off the starter-motor drive command at time t3. This causes the switch 32 and the relay 33 to be turned off. That is, the pinon 12 is disengaged from the ring gear 14, and the starter motor 11 is deenergized at the time t3. This results in the rotational speed of the starter motor 11 gradually falling (see dashed curve C1 in FIG. 2).

At the time t3, when torque supplied from the alternator 21 to the rotating shaft 13 of the engine 10 is sufficient to rotate the rotating shaft 13 of the engine 10, the torque based on the alternator 21 increases the engine rotational speed Ne while the engine rotational speed Ne pulsates.

After the stop of the starter motor 11, the ECU 30 starts the combustion task T1 set forth above at, for example, time t3*a* corresponding to a rotational speed Nth1 of the rotating shaft 13 of the engine 10. Thereafter, torque generated by the alternator 21 and the combustion task T1 cause the engine rotational speed Ne to gradually rise while the engine rotational speed Ne pulsates (see solid curve C2).

When the engine rotational speed Ne exceeds a predetermined first threshold speed Ne1, which serves as, for example, a predetermined threshold speed, at time t4, the control IC 22 terminates the engine starting sequence, thus terminating control of the driver 24, preventing AC power from being supplied to the alternator 21 based on DC power of the battery 31. The first threshold speed Ne1 is set to, for example, a predetermined idle speed at which the rotating shaft 13 of the engine 10 can be idling.

As described above, the control IC 22 is configured to terminate the engine starting sequence that uses the alternator 21 when a predetermined condition, which represents that the engine rotational speed Ne exceeds the first threshold speed Ne1, is satisfied. If driving the alternator 21 did not start the engine 10, the alternator 21 would be continued, because the engine rotational speed Ne would not exceed the first threshold speed Ne1. From this viewpoint, the control IC 22 according to the first embodiment counts time from the start of the engine starting sequence including the engine starting sequence based on the alternator 21. Then, the control IC 22 terminates the engine starting sequence based on the alternator 21 when a predetermined condition, which represents that the counted time has reached a predetermined second threshold time, is satisfied. That is, the condition represents that the second threshold time has elapsed since the start of the engine starting sequence.

Figure 3:
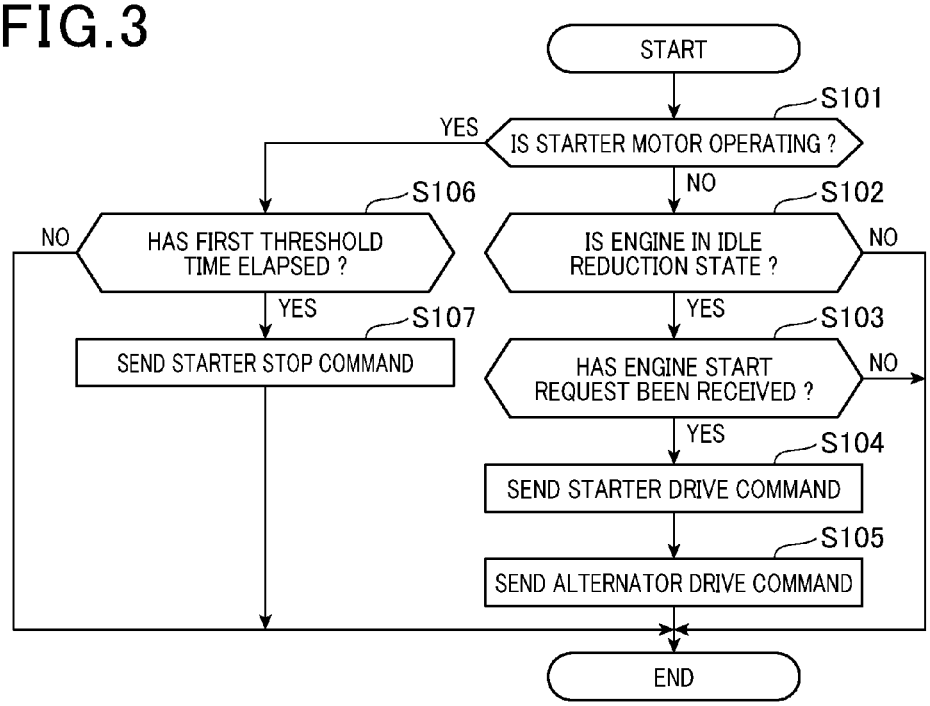
FIG. 3 is a flowchart schematically illustrating a main routine periodically carried out by the ECU according to the first embodiment.

Next, the following describes a main routine repeatedly carried out by the ECU 30 in a predetermined first control period with reference to FIG. 3.

In step S101, the ECU 30 determines whether the starter motor 11 is operating. Specifically, the ECU 30 determines whether it has generated the starter-motor drive command in step S101. When it is determined that the starter motor 11 is not operating (NO in step S101), the ECU 30 determines whether the engine 10 is in the idle reduction state in step S102.

For example, the ECU 30 performs the idle reduction control task set forth above in response to detection of the driver's depression of the brake pedal 43 while the travelling speed of the vehicle V is equal to or lower than the predetermined speed. This results in the engine 10 being in the idle reduction state, so that the engine rotational speed Ne falls.

When it is determined that the engine 10 is in the idle reduction state (YES in step S102), the ECU 30 determines whether the engine start request has been received from the driver of the vehicle V in step S103. When it is determined that the engine start request has been received from the driver of the vehicle V (YES in step S103), the main routine proceeds to step S104.

Otherwise, when it is determined that the engine 10 is not in the idle reduction state (NO in step S102), or when it is determined that the engine start request has not been received from a driver of the vehicle V (NO in step S103), the ECU 30 terminates the main routine.

In step S104, the ECU 30 generates the starter-motor drive command, and sends the starter-motor drive command to the relay 33, thus turning on the relay 33. This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on. This starts DC supply of DC power to the starter motor 11. When the starter motor 11 is activated based on the supplied DC power, rotational power of the starter motor 11 is transferred to the rotating shaft 13 of the engine 10.

In step S104, the ECU 30 also counts time from the sending of the starter-motor drive command to the relay 33.

Subsequently or simultaneously, the ECU 30 generates an alternator drive command, and sends the alternator drive command to the control IC 22 in step S105. Thereafter, the ECU 30 terminates the main routine.

Otherwise, when it is determined that the starter motor 11 is operating (YES in step S101), the ECU 30 determines whether the counted time has reached a predetermined first threshold time in step S106. When it is determined that the counted time has not reached the first threshold time (NO in step S106), the ECU 30 terminates the main routine without executing the following operation in step S107, thus continuing rotation of the starter motor 11.

Otherwise, when it is determined that the counted time has reached the first threshold time (YES in step S106), the ECU 30 turns off the starter-motor drive command, in other words, sends a starter stop command to the switch 32 and the relay 33, thus turning off the switch 32 and relay 33 in step S107. Thereafter, the ECU 30 terminates the main routine.

After the stop of the stator motor 11, the ECU 30 performs the combustion task T1 when the engine rotational speed Ne becomes the rotational speed Nth1, thus increasing the engine rotational speed Ne.

Figure 4:
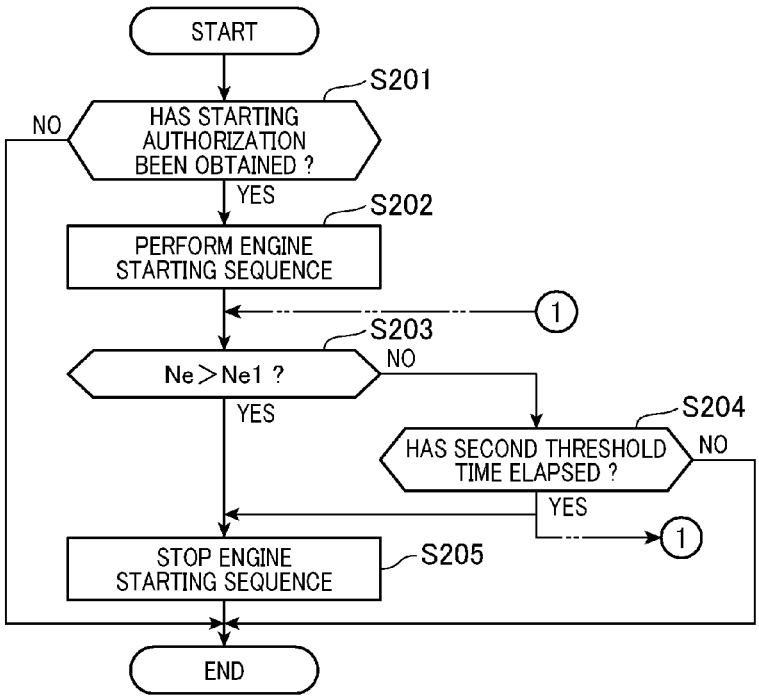
FIG. 4 is a flowchart schematically illustrating a subroutine periodically carried out by the control IC according to the first embodiment.

Next, the following describes a subroutine repeatedly carried out by the control IC 22 in a predetermined second control period with reference to FIG. 4. The second control period can be set to be identical to or different from the first control period. Note that the main routine and the subroutine constitute an engine starting process.

In step S201, the control IC 22 determines whether it has received the alternator drive command from the ECU 30 so that starting authorization has been obtained. When it is determined that starting authorization has not been obtained (NO in step S201), the control IC 22 does not drive the alternator 21 and terminates the subroutine.

Otherwise, when it is determined that starting authorization has been obtained, that is, a starting condition is satisfied (YES in step S201), the control IC 22 controls the driver 24 to start the engine starting sequence set forth above in step S202.

Specifically, in step S202, the control IC 22 causes the driver 24 to apply the three-phase AC power to the three-phase stator coils, thus generating the rotating magnetic field. The rotating magnetic field rotates the rotor 21*a*, that is, generates torque of the rotor 21*a*, based on the interactions with respect to the magnetic field generated in the rotor 21*a*. The generated torque is transferred from the alternator 21 to the rotating shaft 13 of the engine 10 through the power transfer mechanism 16.

In step S202, the control IC 22 also counts time from the starting of the engine starting sequence.

Following the operation in step S202, the control IC 22 determines whether the engine rotational speed Ne is higher than the first threshold speed Ne1 in step S203. Specifically, in step S203, the control IC 22 calculates the engine rotational speed Ne based on the rotational speed of the rotor 21*a* of the alternator 21, and determines whether the calculated engine rotational speed Ne is higher than the first threshold speed Ne1 in step S203.

When it is determined that the engine rotational speed Ne is equal to or lower than the first threshold speed Ne1 (NO in step S203), the control IC 22 determines whether the counted time has reached the second threshold time in step S204. When it is determined that the counted time has not reached the second threshold time (NO in step S204), the control IC 22 terminates the subroutine without withdrawing the starting permission in step S205. This enables the control IC 22 to perform the engine starting sequence in the next cycle of the subroutine.

Otherwise, when it is determined that the engine rotational speed Ne is higher than the first threshold speed Ne1 (YES in step S203), the control IC 22 stops the engine starting sequence and withdraws the starting permission in step S205. Similarly, the control IC 22 stops the engine starting sequence and withdraws the starting permission when it is determined that the counted time has reached the second threshold time (YES in step S204) in step S205.

As described above, the control IC 22 of the engine starting system 100 is configured to perform the engine starting sequence, i.e. the engine starting task, based on the alternator 21 for starting the engine 10 in response to the alternator drive command sent from the ECU 30. The control IC 22 is also configured to stop the engine starting sequence based on the alternator 21 when the engine rotational speed Ne has reached the first threshold speed Ne1 without receiving any engine starting sequence stop commands from the ECU 30.

This configuration enables communications between the ECU 30 and the control IC 22 during starting of the engine 10 to be limited to only sending and receiving of the trigger signal indicative of the alternator drive command. That is, the ECU 30 does not control the control IC 22 and only sends the trigger signal indicative of the alternator drive command to the control IC 22; this alternator drive command enables the control IC 22 to drive the alternator 21 for starting the engine 10.

This configuration therefore enables the ECU 30 to rapidly send the alternator drive command to the control IC 22 without being affected from an increase of the processing load of the ECU 30 during the starting of the engine 10, resulting in faster starting of the engine 10.

The engine starting system 100 is configured such that the engine starting sequence, which activates and deactivates the alternator 21 in response to receiving the alternator drive command, is installed in the control IC 22 of the motor-generator apparatus 20. This configuration enables simpler communications between the ECU 30 and the control IC 22 to control the alternator 21. This results in the engine starting system 100 having a simpler configuration as compared with an ISG system equipped with a microcomputer for controlling a motor-generator in addition to an ECU. This results in a lower manufacturing cost of the engine starting system 100.

The control IC 22 for performing the engine control sequence, which activates and deactivates the alternator 21 for starting the engine 10 in response to receiving the alternator drive command, is provided independently from the ECU 30. This enables software programs of smaller size to be installed in the ECU 30, resulting in a smaller number of software program calibration processes and less software development effort.

The larger torque generated by the alternator 21, the higher endurance of the belt of the power transfer mechanism 16 need be. The larger toque generated by the alternator 21 also might result in a belt tensioner being provided for tensioning the belt.

From this viewpoint, the engine starting system 100 is configured such that the starter motor 11 applies larger torque to the rotating shaft 13 of the engine 10 at the start of rotation of the rotating shaft 13. This results in smaller torque having to be generated by the alternator 21. This eliminates the need to use a belt having a higher endurance, and the need to provide a belt tensioner for tensioning the belt of the power transfer mechanism 16. This results in a lower manufacturing cost of the engine starting system 100.

The control IC 22 of the engine starting system 100 is configured to stop the engine starting sequence based on the alternator 21 when the predetermined end condition is satisfied. The predetermined end condition is that the predetermined second threshold time has elapsed since the starting of the engine starting sequence while the engine rotational speed Ne is equal to or lower than the first threshold speed Ne1. This prevents the engine starting sequence based on the alternator 21 from being endlessly performed.

Second Embodiment

The following describes an engine starting system according to the second embodiment of the present disclosure. The structure and/or functions of the engine starting system according to the second embodiment differ from the engine starting system 100 according to the first embodiment in the following points. So, the following mainly describes the different points.

The engine starting system according to the second embodiment is configured such that the main routine and the subroutine of the second embodiment are partly different from the respective main routine and the subroutine of the first embodiment.

Specifically, the ECU 30 performs the main routine illustrated in FIG. 3, and the control IC 22 starts to perform the engine starting sequence in response to the alternator drive command sent from the ECU 30.

At that time, when it is determined that the second threshold time has elapsed since the starting of the engine starting sequence while the engine rotational speed Ne is kept to be equal to or lower than the first threshold speed Ne1 (YES in step S204 of the subroutine), the control IC 22 repeatedly performs the determination in step S203 while performing the engine starting sequence (see the two-dot chain arrow in FIG. 4).

When a predetermined check time for determining whether torque generated by the alternator 21 causes the engine rotational speed Ne to have increased has elapsed since the stop of the starter motor 11, the ECU 30 performs a task T2 of determining whether the engine rotational speed Ne has increased up to a predetermined check speed. When it is determined that the engine rotational speed Ne has increased up to the predetermined check speed (YES in the task T2), the ECU 30 terminates the task T2.

Otherwise, when it is determined that the engine rotational speed Ne has not increased up to the predetermined check speed (NO in the task T2), the ECU 30 performs a task T3 of generating a second starter-motor drive command, and sending the second starter-motor drive command to the relay 33, thus driving the starter motor 11 the second time. In addition, the ECU 30 performs the combustion task T1 when the engine rotational speed Ne becomes a rotational speed Nth2, which is lower than the rotational speed Nth1, while the starter motor 11 is operating to rotate the rotating shaft 13 of the engine 10. This increases the engine rotational speed Ne.

Figure 5:
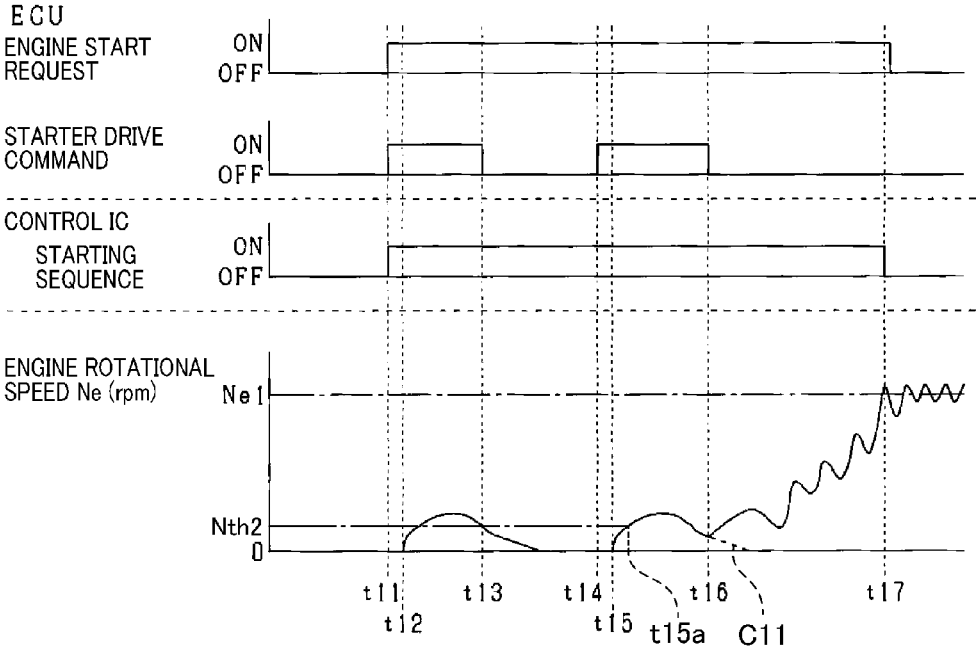
FIG. 5 is a timing chart schematically illustrating an engine starting process carried out by the ECU and the control IC according to the second embodiment of the present disclosure.

Referring to FIG. 5, a driver of the vehicle V inputs the engine start request to the ECU 30 at time t11. In response to the engine start request, the ECU 30 turns on the starter-motor drive command at the time t11, thus turning on the relay 33. This causes the solenoid mechanism 15 to shift the pinion 12 from the predetermined initial position to the ring gear 14 so that the pinion 12 is engaged with the ring gear 14.

At the time t11, the ECU 30 sends, as a trigger signal, the alternator drive command to the control IC 22 in response to the engine start request. When receiving the alternator drive command as the trigger signal at the time t11, the control IC 22 starts the engine starting sequence including the engine starting sequence at the time t11.

On the other hand, the shifting operation of the pinion 12 to the ring gear 14 causes the switch 32 to be turned on at time t12. This starts supply of DC power to the starter motor 11. When the starter motor 11 is activated based on the supplied DC power, rotational power of the starter motor 11 is transferred to the rotating shaft 13 of the engine 10. This results in the engine rotational speed Ne starting to rise.

When the first threshold time has elapsed since the time t11, the ECU 30 turns off the starter-motor drive command at time t13. This causes the switch 32 and the relay 33 to be turned off. That is, the pinon 12 is disengaged from the ring gear 14, and the starter motor 11 is deenergized at the time t13. This results in the rotational speed of the starter motor 11 gradually falling.

When the predetermined check time set forth above has elapsed since the stop of the starter motor 11 at time t14, the ECU 30 performs the task T2 to determine whether the engine rotational speed Ne has increased up to the predetermined check speed at the time t14.

When it is determined that the engine rotational speed Ne has not increased up to the predetermined check speed (NO in the task T2), the ECU 30 performs the task T3 of generating the second starter-motor drive command, and sending, as a trigger signal, the second starter-motor drive command to the relay 33 at the time t14.

This turns on the relay 33, causing the solenoid mechanism 15 to shift the pinion 12 from the predetermined initial position to the ring gear 14 so that the pinion 12 is engaged with the ring gear 14 at the time t14.

The shifting operation of the pinion 12 to the ring gear 14 causes the switch 32 to be turned on at time t15. This starts DC power being supplied to the starter motor 11. When the starter motor 11 is activated based on the supplied DC power, rotational power of the starter motor 11 is transferred to the rotating shaft 13 of the engine 10 at the time t15. This results in the engine rotational speed Ne starting to rise.

While the starter motor 11 is operating to rotate the rotating shaft 13 of the engine 10, the ECU 30 performs the combustion task T1 when the engine rotational speed Ne becomes the rotational speed Nth2, which is lower than the rotational speed Nth1.

That is, while the starter motor 11 is operating to rotate the rotating shaft 13 of the engine 10 in response to the second starter-motor drive command, the combustion task T1 is carried out. The combustion task T1 sprays a suitable injection quantity into a sequentially selected cylinder of the engine 10, and causes the corresponding igniter to ignite the compressed air-fuel mixture or the mixture of the compressed air and fuel in the corresponding cylinder at a proper timing.

This enables both torque based on the alternator 21 and torque generated by the combustion task T1 to increase the engine rotational speed Ne while the engine rotational speed Ne pulsates (see solid curve C12 in FIG. 5).

When the first threshold time has elapsed since the time t14, the ECU 30 turns off the second starter-motor drive command at time t16. This causes the switch 32 and the relay 33 to be turned off. That is, the pinon 12 is disengaged from the ring gear 14, and the starter motor 11 is deenergized at the time t16. This results in the rotational speed of the starter motor 11 gradually falling (see dashed curve C11 in FIG. 5). Note that the period from the time t14 to the time t16 for which the starter motor 11 is driven on the second occasion is set to be, for example, equal to the period from the time t1 to the time t3 for which the starter motor 11 is driven in the first time.

Thereafter, when the engine rotational speed Ne exceeds the first threshold speed Ne1 at time t17, the control IC 22 terminates the engine starting sequence (see YES in steps S204 and S205). This terminates control of the driver 24, thus preventing AC power from being supplied to the alternator 21 based on DC power of the battery 31.

As described above, the engine starting system according to the second embodiment is configured to drive the starter motor 11 in the first time and drive the alternator 21 in order to increase the engine rotational speed Ne. This configuration results in an improvement of the fuel economy and emission performance of the vehicle V if the first driving of the starter motor 11 and driving of the alternator 21 enable the engine rotational speed Ne to have reached the first threshold speed Ne1.

In contrast, even if the first driving of the starter motor 11 and driving of the alternator 21 result in difficulty for the engine rotational speed Ne to increase, the engine starting system is configured to (1) Drive the starter motor 11 on the second occasion (2) Perform the combustion task T1 at the timing when the engine rotational speed Ne becomes the rotational speed Nth2, which is lower than the rotational speed Nth1.

This configuration specially enables the engine 10 to be started by the starter motor 11 even if it is difficult to drive the alternator 21 due to, for example, reduction of the power supply to the alternator 21. This therefore improves the fuel economy and emission performance of the vehicle V while capable of reliably starting the engine 10 even if the alternator 21 has malfunctioned.

Third Embodiment

The following describes an engine starting system according to the third embodiment of the present disclosure. The structure and/or functions of the engine starting system according to the third embodiment differ from the engine starting system 100 according to the first or second embodiment in the following points. So, the following mainly describes the different points.

The engine starting system according to the third embodiment is configured such that the main routine and the subroutine of the third embodiment are partly different from the respective main routine and the subroutine of the second embodiment.

Specifically, the ECU 30 performs the main routine illustrated in FIG. 3, and the control IC 22 starts to perform the engine starting sequence in response to the alternator drive command sent from the ECU 30.

At that time, when it is determined that the second threshold time has elapsed since the starting of the engine starting sequence while the engine rotational speed Ne is kept to be equal to or lower than the first threshold speed Ne1 (YES in step S204 of the subroutine), the control IC 22 repeatedly performs the determination in step S203 while performing the engine starting sequence (see the two-dot chain arrow in FIG. 4).

When the check time has elapsed since the stop of the starter motor 11, the ECU 30 performs the task T2 of determining whether the engine rotational speed Ne has increased up to the check speed. When it is determined that the engine rotational speed Ne has increased up to the check speed (YES in the task T2), the ECU 30 terminates the task T2.

Otherwise, when it is determined that the engine rotational speed Ne has not increased up to the check speed (NO in the task T2), the ECU 30 performs the task T3 of generating the second starter-motor drive command, and sending the second starter-motor drive command to the relay 33, thus driving the starter motor 11 in the second time.

In addition, the ECU 30 performs the combustion task T1 when the engine rotational speed Ne becomes the rotational speed Nth2, which is lower than the rotational speed Nth1, while the starter motor 11 is operating to rotate the rotating shaft 13 of the engine 10. This increases the engine rotational speed Ne.

In particular, the ECU 30 performs the task T3 such that the period for which the starter motor 11 is driven at the second time is longer than the period for which the starter motor 11 is driven at the first time.

Figure 6:
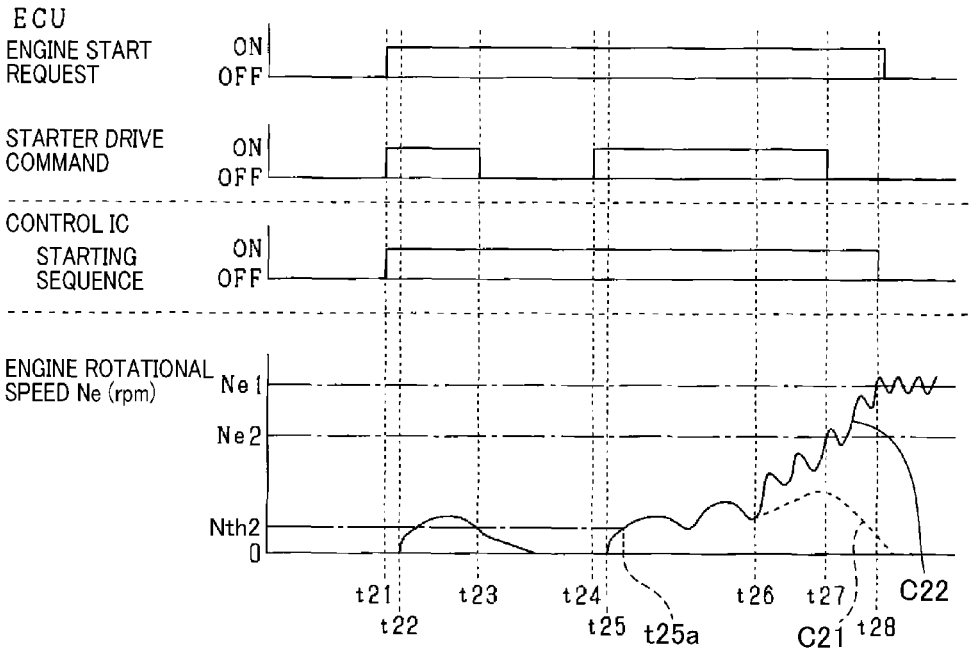
FIG. 6 is a timing chart schematically illustrating an engine starting process carried out by the ECU and the control IC according to the third embodiment of the present disclosure.

Referring to FIG. 6, a driver of the vehicle V inputs the engine start request to the ECU 30 at time t21. In response to the engine start request, the ECU 30 turns on the starter-motor drive command at the time t21, thus turning on the relay 33. This causes the solenoid mechanism 15 to shift the pinion 12 from the predetermined initial position to the ring gear 14 so that the pinion 12 is engaged with the ring gear 14.

At the time t21, the ECU 30 sends, as a trigger signal, the alternator drive command to the control IC 22 in response to the engine start request. When receiving the alternator drive command as the trigger signal at the time t21, the control IC 22 starts the engine starting sequence including the engine starting sequence at the time t21.

On the other hand, the shifting operation of the pinion 12 to the ring gear 14 causes the switch 32 to be turned on at time t22. This starts DC power being supplied to the starter motor 11. When the starter motor 11 is activated using the supplied DC power, rotational power of the starter motor 11 is transferred to the rotating shaft 13 of the engine 10. This results in the engine rotational speed Ne starting to rise.

When the first threshold time has elapsed since the time t21, the ECU 30 turns off the starter-motor drive command at time t23. This causes the switch 32 and the relay 33 to be turned off. That is, the pinon 12 is disengaged from the ring gear 14, and the starter motor 11 is deenergized at the time t23. This results in the rotational speed of the starter motor 11 gradually falling.

When the predetermined check time set forth above has elapsed since the stop of the starter motor 11 at time t14, the ECU 30 performs the task T2 to determine whether the engine rotational speed Ne has increased up to the predetermined check speed at the time t24.

When it is determined that the engine rotational speed Ne has not increased up to the predetermined check speed (NO in the task T2), the ECU 30 performs the task T3 of generating the second starter-motor drive command, and sending, as a trigger signal, the second starter-motor drive command to the relay 33 at the time t24.

This turns on the relay 33, causing the solenoid mechanism 15 to shift the pinion 12 from the predetermined initial position to the ring gear 14 so that the pinion 12 is engaged with the ring gear 14 at the time t24.

The shifting operation of the pinion 12 to the ring gear 14 causes the switch 32 to be turned on at time t25. This starts DC power being supplied to the starter motor 11. When the starter motor 11 is activated based on the supplied DC power, rotational power of the starter motor 11 is transferred to the rotating shaft 13 of the engine 10 at the time t25. This results in the engine rotational speed Ne starting to rise.

While the starter motor 11 is operating to rotate the rotating shaft 13 of the engine 10, the ECU 30 performs the combustion task T1 when the engine rotational speed Ne becomes the rotational speed Nth2, which is lower than the rotational speed Nth1. The combustion task T1 causes first ignition, i.e. first firing, in a cylinder of the engine 10 at, for example, time t25*a* corresponding to the rotational speed Nth2 of the rotating shaft 13 of the engine 10.

That is, while the starter motor 11 is operating to rotate the rotating shaft 13 of the engine 10 in response to the second starter-motor drive command, the combustion task T1 is carried out. The combustion task T1 sprays a suitable quantity into a sequentially selected cylinder of the engine 10, and causes the corresponding igniter to ignite the compressed air-fuel mixture or the mixture of the compressed air and fuel in the corresponding cylinder at a proper timing.

This enables both torque based on the alternator 21 and torque generated by the combustion task T1 to increase the engine rotational speed Ne. The combustion task T1 results in the occurrence of first firing in a cylinder of the engine 10 at, for example, time t26. That is, torque generated by the alternator 21 and the combustion task T1 cause the engine rotational speed Ne to rise while the engine rotational speed Ne pulsates (see solid curve C22).

Thereafter, when the engine rotational speed Ne exceeds a second threshold speed Ne2 at time t27, the ECU 30 turns off the second starter-motor drive command at the time t27. This causes the switch 32 and the relay 33 to be turned off. That is, the pinon 12 is disengaged from the ring gear 14, and the starter motor 11 is deenergized at the time t27. This results in the rotational speed of the starter motor 11 gradually falling (see dashed curve C21 in FIG. 6).

Thereafter, when the engine rotational speed Ne has increased to exceed the first threshold speed Ne1 at time t28, the control IC 22 terminates the engine starting sequence (see YES in steps S204 and S205) independently of whether there is a malfunction in the alternator 21. This terminates control of the driver 24, thus preventing AC power from being supplied to the alternator 21 based on DC power of the battery 31.

As described above, similar to the second embodiment, the engine starting system enables the engine 10 to be started by the starter motor 11 and torque generated by the combustion task T1 even if there is a malfunction in the alternator 21 while there is no need for the ECU 30 to communicate with the control IC 22 during the starting of the engine 10. This minimizes the adverse effects of communications delay between the ECU 30 and the control IC 22 due to a malfunction in the alternator 21, thus smoothly starting the engine 10.

Fourth Embodiment

The following describes an engine starting system according to the fourth embodiment of the present disclosure. The structure and/or functions of the engine starting system according to the fourth embodiment differ from the engine starting system 100 according to the first embodiment in the following points. So, the following mainly describes the different points.

The engine starting system according to the fourth embodiment is configured such that the timing to start the starter motor 11 and the timing to start the alternator 21 in response to the engine start request are shifted from each other.

Figure 7:
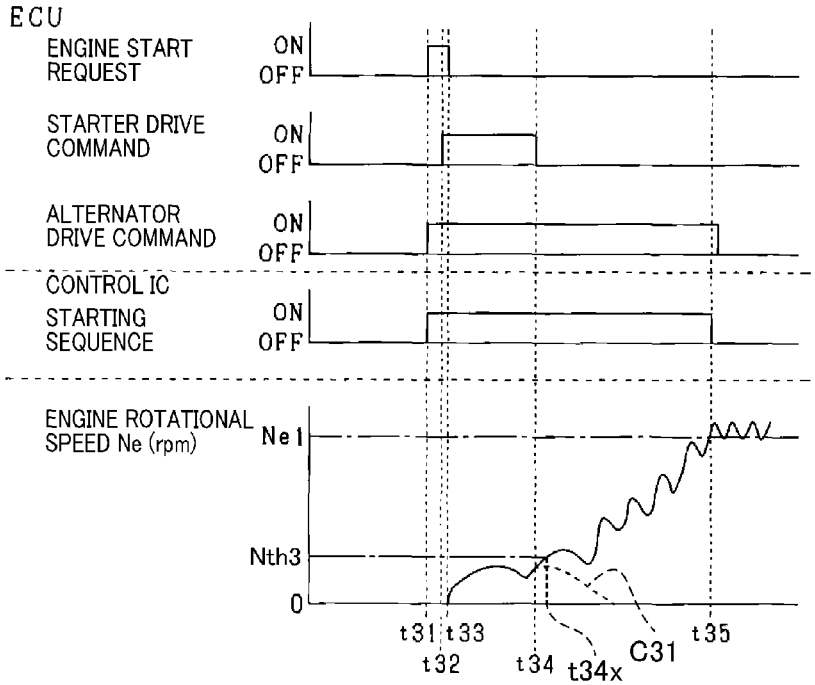
FIG. 7 is a timing chart schematically illustrating one example of an engine starting process carried out by the ECU and the control IC according to the fourth embodiment of the present disclosure.

Referring to FIG. 7, a driver of the vehicle V inputs the engine start request to the ECU 30 at time t31. In response to the engine start request, the ECU 30 sends, as a trigger signal, the alternator drive command to the control IC 22 at the time t31 (see step S105). When receiving the alternator drive command as the trigger signal at the time t31, the control IC 22 starts the engine starting sequence including the engine starting sequence at the time t31 (see steps S201 and S202). At that time, the engine rotational speed Ne does not increase, because torque of the alternator 21 is insufficient to increase the engine rotational speed Ne.

The ECU 30 turns on the starter-motor drive command at time t32 when a predetermined time interval has elapsed since the time t31, thus turning on the relay 33 (see step S104). This causes the solenoid mechanism 15 to shift the pinion 12 from the predetermined initial position to the ring gear 14 so that the pinion 12 is engaged with the ring gear 14. The ECU 30 can change the interval between the time t31 and the time t32 depending on, for example, the output voltage of the battery 31 and/or the temperatures of the components of the engine 10.

The shifting operation of the pinion 12 to the ring gear 14 causes the switch 32 to be turned on at time t33. This starts DC power being supplied to the starter motor 11. When the starter motor 11 is activated based on the supplied DC power, rotational power of the starter motor 11 is transferred to the rotating shaft 13 of the engine 10. When torque generated by the starter motor 11 increases up to a level sufficient to increase the engine rotational speed Ne, the engine rotational speed Ne starts to rise.

When a third threshold time has elapsed since the time t32, the ECU 30 turns off the starter-motor drive command at time t34. This causes the switch 32 and the relay 33 to be turned off. That is, the pinon 12 is disengaged from the ring gear 14, and the starter motor 11 is deenergized at the time t34. This results in the rotational speed of the starter motor 11 gradually falling (see dashed curve C31 in FIG. 7).

At the time t34, when torque supplied from the alternator 21 to the rotating shaft 13 of the engine 10 is sufficient to increase the engine rotational speed Ne, the torque based on the alternator 21 increases the engine rotational speed Ne.

On the other hand, after the stop of the starter motor 11, the ECU 30 starts the combustion task T1 set forth above at, for example, time t34*x* corresponding to a rotational speed Nth3 of the rotating shaft 13 of the engine 10.

This results in the occurrence of first firing in a cylinder of the engine 10. That is, torque generated by the alternator 21 and the combustion task T1 increase the engine rotational speed Ne while the engine rotational speed Ne pulsates (see solid curve C32).

Thereafter, when the engine rotational speed Ne exceeds the first threshold speed Ne1 at time t35, the control IC 22 terminates the engine starting sequence, thus terminating control of the driver 24, preventing AC power from being supplied to the alternator 21 based on DC power of the battery 31. When the control IC 22 terminates the engine starting sequence, the engine 10 has been fired up, so that the rotating shaft 13 of the engine 10 is rotated by only the combustion task T1 of the engine 10.

Note that the engine starting system according to the fourth embodiment changes the timing to start the starter motor 11 and the timing to start the alternator 21 in response to the engine start request from each other in the timing chart illustrated in FIG. 7. The engine starting system according to the fourth embodiment can change the timing to start the starter motor 11 and the timing to start the alternator 21 in response to the engine start request from each other in the timing chart illustrated in FIG. 8 or FIG. 9.

That is, the rotation starting of the alternator, which is a three-phase AC rotary electric machine, 21 is known to be later than the rotation starting of a DC rotary electric machine. The rotation starting timing of the alternator 21 in response to the alternator drive command varies depending on its hardware characteristics and its control characteristics. From this viewpoint, the engine starting system according to the fourth embodiment is designed to properly determine the timing to start of the alternator 21 based on its hardware characteristics and its control characteristics, making it possible to achieve proper starting performance of the alternator 21 in response to the alternator drive command.

Figure 8:
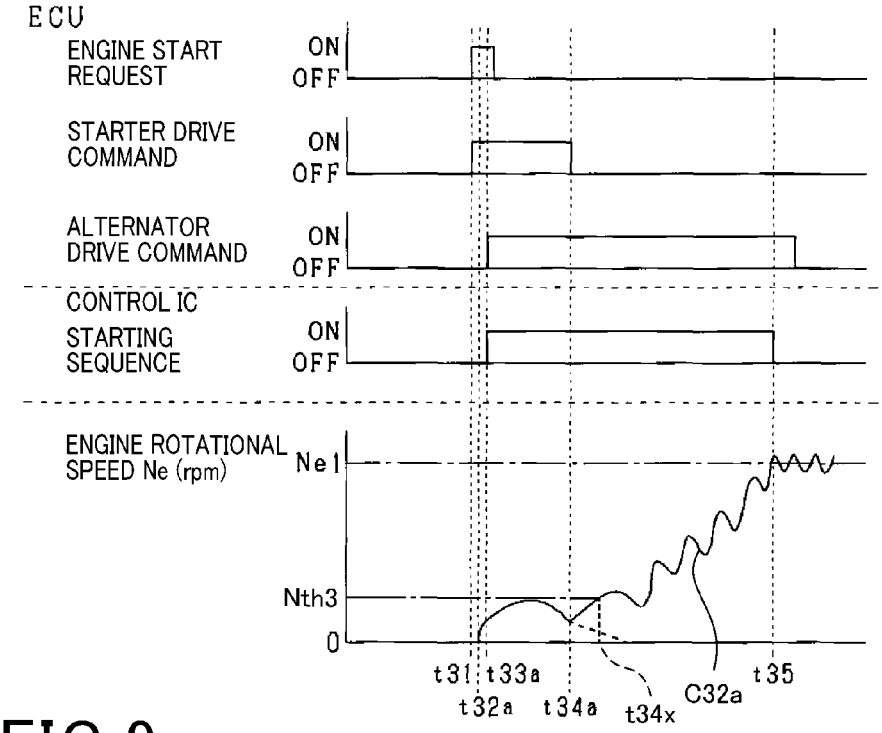
FIG. 8 is a timing chart schematically illustrating another example of the engine starting process carried out by the ECU and the control IC according to the fourth embodiment of the present disclosure.

For example, the timing chart of FIG. 8 illustrates an example where the timing to start the alternator 21 is set to be later than the timing to start the starter motor 11.

Referring to FIG. 8, a driver of the vehicle V inputs the engine start request to the ECU 30 at time t31. In response to the engine start request, the ECU 30 turns on the starter-motor drive command at the time t31, thus turning on the relay 33. This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on at time t32*a*. This starts DC power being supplied to the starter motor 11. When the starter motor 11 is activated based on the supplied DC power, rotational power of the starter motor 11 is transferred to the rotating shaft 13 of the engine 10. When torque generated by the starter motor 11 is sufficient to increase the engine rotational speed Ne, the engine rotational speed Ne starts to rise.

Thereafter, at time t33*a*, the ECU 30 sends, as a trigger signal, the alternator drive command to the control IC 22 (see step S105). When receiving the alternator drive command as the trigger signal at the time t33*a*, the control IC 22 starts the engine starting sequence, i.e. the engine starting task, at the time t33*a* (see steps S201 and S202).

When the third threshold time has elapsed since the time t31, the ECU 30 turns off the starter-motor drive command at time t34*a*. This causes the switch 32 and the relay 33 to be turned off. That is, the pinon 12 is disengaged from the ring gear 14, and the starter motor 11 is deenergized at the time t34. This results in the rotational speed of the starter motor 11 gradually falling (see dashed curve C31*a* in FIG. 8). At that time, when torque generated by the alternator 21 is sufficient to increase the engine rotational speed Ne, the engine rotational speed Ne continuously rises.

On the other hand, after the stop of the starter motor 11, the ECU 30 starts the combustion task T1 set forth above at, for example, time t34*x* corresponding to the rotational speed Nth3 of the rotating shaft 13 of the engine 10.

This results in the occurrence of first firing in a cylinder of the engine 10. That is, torque generated by the alternator 21 and the combustion task T1 increase the engine rotational speed Ne while the engine rotational speed Ne pulsates (see solid curve C32*a*).

Thereafter, when the engine rotational speed Ne exceeds the first threshold speed Ne1 at time t35, the control IC 22 terminates the engine starting sequence, thus terminating control of the driver 24. This prevents AC power from being supplied to the alternator 21 based on DC power of the battery 31. When the control IC 22 terminates the engine starting sequence, the engine 10 has been fired up, enabling the rotating shaft 13 of the engine 10 to be rotated by only the combustion task T1 of the engine 10.

Figure 9:
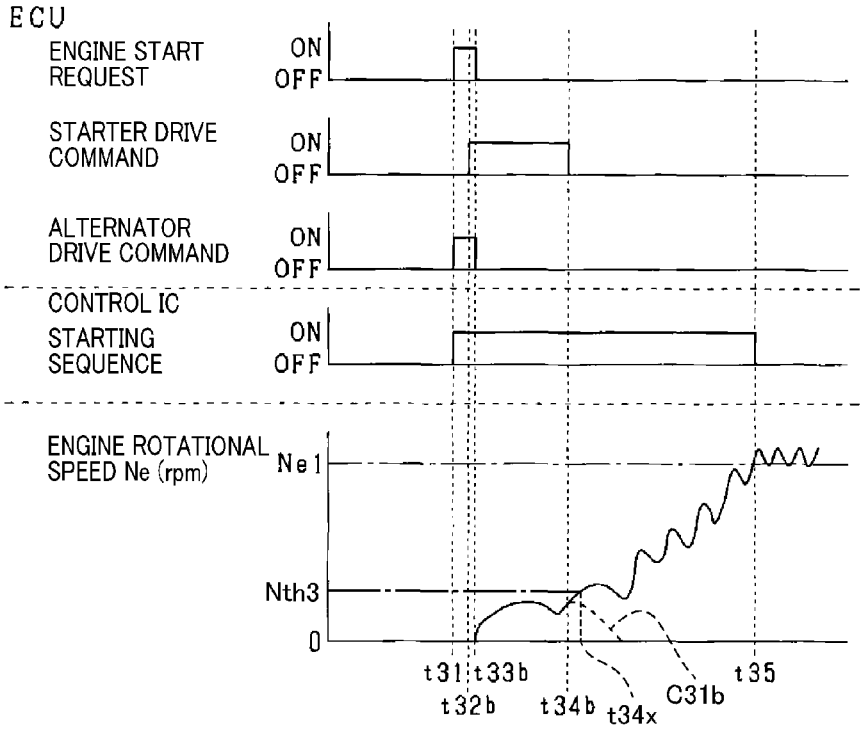
FIG. 9 is a timing chart schematically illustrating a further example of the engine starting process carried out by the ECU and the control IC according to the fourth embodiment of the present disclosure.

For example, the timing chart of FIG. 9 illustrates an example where the timing to start the alternator 21 is set to be earlier than the timing to start the starter motor 11 like the timing chart of FIG. 7. In addition, the alternator drive command is designed as a pulsed trigger signal.

Referring to FIG. 9, a driver of the vehicle V inputs the engine start request to the ECU 30 at time t31. In response to the engine start request, the ECU 30 generates the pulsed alternator drive command as a trigger signal, and sends the pulsed alternator drive command to the control IC 22 at the time t31 (see step S105). When receiving the alternator drive command as the trigger signal at the time t31, the control IC 22 starts the engine starting sequence at the time t31 (see steps S201 and S202). At that time, the engine rotational speed Ne does not increase, because torque of the alternator 21 is insufficient to increase the engine rotational speed Ne.

The ECU 30 turns on the starter-motor drive command at time t32*b* when a predetermined time interval has elapsed since the time t31, thus turning on the relay 33 (see step S104). This causes the solenoid mechanism 15 to shift the pinion 12 from the predetermined initial position to the ring gear 14 so that the pinion 12 is engaged with the ring gear 14. The ECU 30 can change the interval between the time t31 and the time t32*b* depending on, for example, the output voltage of the battery 31 and/or the temperatures of the components of the engine 10.

The shifting operation of the pinion 12 to the ring gear 14 causes the switch 32 to be turned on at time t33*b*. This starts DC power being supplied to the starter motor 11. When the starter motor 11 is activated based on the supplied DC power, rotational power of the starter motor 11 is transferred to the rotating shaft 13 of the engine 10. When torque generated by the starter motor 11 increases up to a level sufficient to increase the engine rotational speed Ne, the engine rotational speed Ne starts to rise.

When the third threshold time has elapsed since the time t32*b*, the ECU 30 turns off the starter-motor drive command at time t34*b*. This causes the switch 32 and the relay 33 to be turned off. That is, the pinon 12 is disengaged from the ring gear 14, and the starter motor 11 is deenergized at the time t34*b*. This results in the rotational speed of the starter motor 11 gradually falling (see dashed curve C31*b* in FIG. 9).

At the time t34*b*, when torque supplied from the alternator 21 to the rotating shaft 13 of the engine 10 is sufficient to increase the engine rotational speed Ne, the torque based on the alternator 21 increases the engine rotational speed Ne.

On the other hand, after the stop of the starter motor 11, the ECU 30 starts the combustion task T1 set forth above at, for example, time t34*x* corresponding to the rotational speed Nth3 of the rotating shaft 13 of the engine 10.

This results in the occurrence of first firing in a cylinder of the engine 10. That is, torque generated by the alternator 21 and the combustion task T1 further increase the engine rotational speed Ne while the engine rotational speed Ne pulsates (see solid curve C32*b*).

Thereafter, when the engine rotational speed Ne exceeds the first threshold speed Ne1 at time t35, the control IC 22 terminates the engine starting sequence, thus terminating control of the driver 24. This prevents AC power from being supplied to the alternator 21 based on DC power of the battery 31. When the control IC 22 terminates the engine starting sequence, the engine 10 has been fired up, enabling the rotating shaft 13 of the engine 10 to be rotated by only the combustion task T1 of the engine 10.

As described above, the engine starting system according to the fourth embodiment is configured to perform the engine starting sequence for the engine 10 based on the alternator 21 depending on the hardware characteristics and the control characteristics of the alternator 21. This achieves, in addition to the advantageous effects achieved by the first embodiment, an advantageous effect of the engine 10 having improved starting performance independently of variations in the hardware characteristics and the control characteristics of the alternator 21.

Fifth Embodiment

The following describes an engine starting system according to the fifth embodiment of the present disclosure. The structure and/or functions of the engine starting system according to the fifth embodiment differ from the engine starting system 100 according to the first embodiment in the following points. So, the following mainly describes the different points.

Specifically, the ECU 30 performs an idle reduction control task that cuts the supply of fuel to the engine 10 when detecting the driver's depression of the brake pedal 43 based on the measurement signal sent from the brake sensor 44.

The control IC 22 performs a reverse-rotation reduction sequence, i.e. a reverse-rotation reduction task, that controls the driver 24 to apply positive torque from the alternator 21 to the rotating shaft 13, thus preventing the rotating shaft 13 of the engine 10 from rotating in a reverse direction opposite to the forward direction while the ECU 30 is performing the idle reduction control task.

The reverse-rotation reduction sequence is configured to control the rotational speed of the alternator 21 such that the quantity of decrease of the engine rotational speed Ne per unit time matches with a predetermined quantity. The reverse-rotation reduction sequence aims to prevent abrupt decrease of the engine rotational speed Ne to thereby prevent reverse rotation of the rotating shaft 13 of the engine 10

Figure 10:
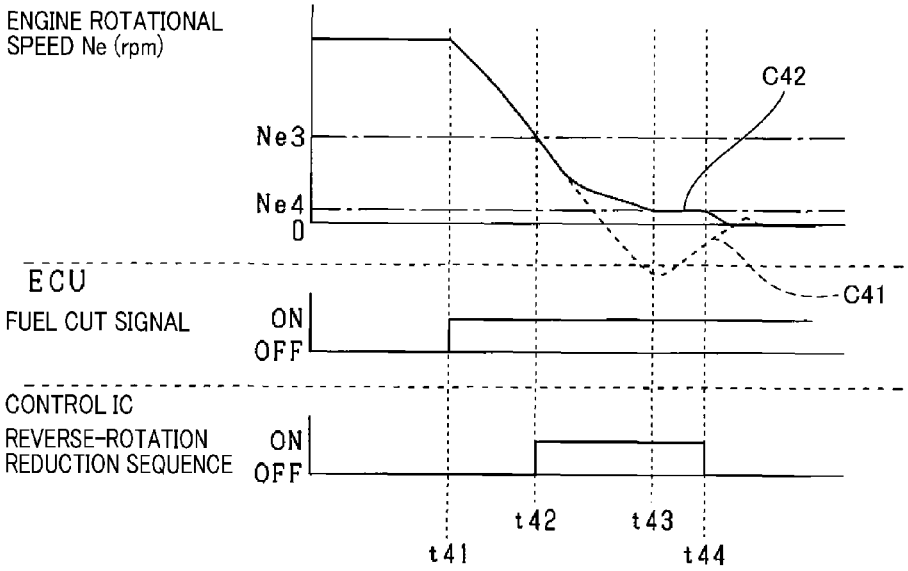
FIG. 10 is a timing chart schematically illustrating an engine starting process carried out by the ECU and the control IC according to the fifth embodiment of the present disclosure.

The following describes the reverse-rotation reduction sequence with reference to the timing chart illustrated in FIG. 10. The dashed curve C41 of FIG. 10 illustrates how the engine rotational speed Ne would change if the reverse-rotation reduction sequence were not carried out.

At time t41, the ECU 30 generates a fuel cut signal in response to detection of the driver's depression of the brake pedal 43 while the travelling speed of the vehicle V, which can be obtained based on the engine rotational speed Ne, is equal to or lower than a predetermined speed. This starts to perform the idle reduction control task, i.e. a fuel cut task. This controls the fuel injection system 10*a* based on the fuel cut signal to prevent the fuel injection system 10*a* from spraying fuel from the respective injectors into the corresponding cylinders or the intake manifold of the engine 10. This results in the engine 10 being in an idle reduction state, resulting in the vehicle V coasting.

Stopping the supply of fuel into the cylinders or intake manifold of the engine 10 in response to the fuel cut signal causes the engine rotational speed Ne to fall. At that time, the ECU 30 sends an enabling signal to enable execution of the reverse-rotation reduction sequence to the control IC 22.

Thereafter, when receiving the enabling signal, the control IC 22 obtains the engine rotational speed Ne based on the rotational speed of the alternator 21 and the predetermined speed reduction ratio of the power transfer mechanism 16. Then, the control IC 22 determines whether the engine rotational speed Ne has fallen to be lower than a predetermined third threshold speed Ne3, and starts to perform the reverse-rotation reduction sequence when the engine rotational speed Ne has fallen to be lower than the third threshold speed Ne3 at time t42.

That is, turning of the rotating shaft 13 of the engine 10 is transferred to the alternator 21, because the rotating shaft 13 of the engine 10 is coupled to the alternator 21 via the power transfer mechanism 16. This causes electromotive force, that is, three-phase AC power, to be induced in the alternator 21. The control IC 22 obtains the induced electromotive force measured by the rotation parameter detector 23, thus calculating the rotational speed of the alternator 21. Then, the control IC 22 calculates the engine rotational speed Ne based on the rotational speed of the alternator 21 and the speed reduction ratio of the power transfer mechanism 16. Note that a rotation sensor can be provided to measure the rotational speed of the alternator 21, and the control IC 22 can calculate the engine rotational speed Ne based on the rotational speed of the alternator 21 measured by the rotation sensor and the speed reduction ratio of the power transfer mechanism 16.

The control IC 22 performs the reverse-rotation reduction sequence to control the driver 24 to drive the alternator 21 such that the quantity of decrease of the engine rotational speed Ne per unit time matches with the predetermined quantity (see solid curve C42 in FIG. 10).

When the engine rotational speed Ne continuously falls down to a predetermined fourth threshold speed Ne4 at time t43, the control IC 22 performs a rotational-speed maintenance sequence that controls the driver 24 to drive the alternator 21 such that the engine rotational speed Ne is maintained at the fourth threshold speed Ne4 or thereabout for a predetermined period. When the predetermined period has elapsed since the start of maintaining the engine rotational speed Ne at the fourth threshold speed Ne4 or thereabout, the control IC 22 terminates the reverse-rotation reduction sequence.

Figure 11:
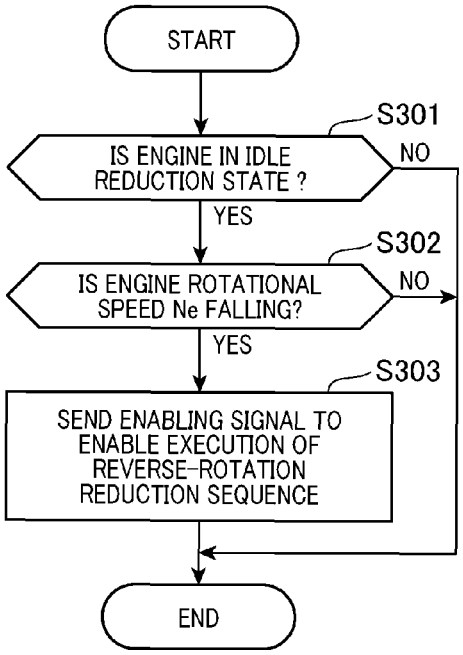
FIG. 11 is a flowchart schematically illustrating a main routine periodically carried out by the ECU according to the fifth embodiment.
Figure 12:
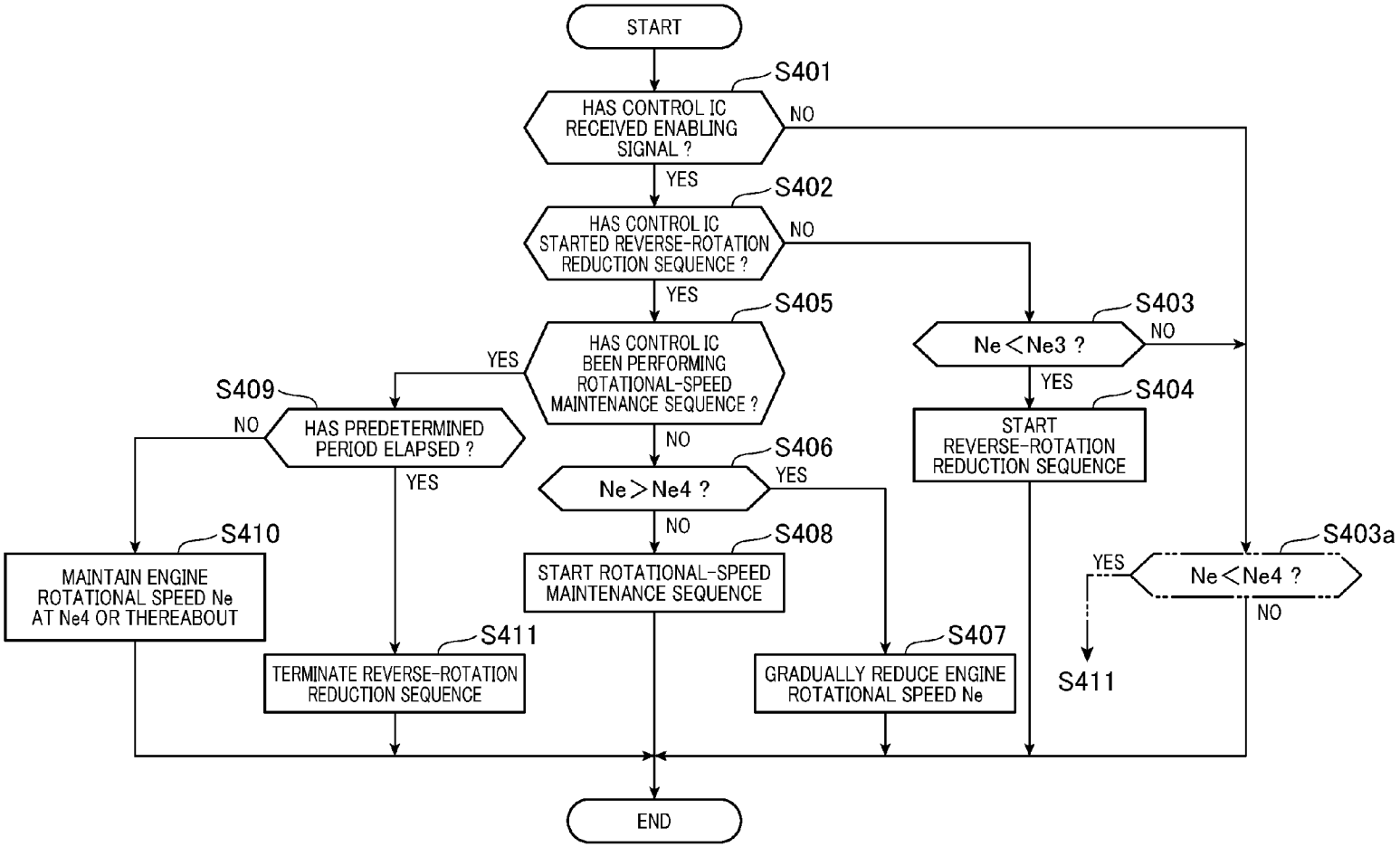
FIG. 12 is a flowchart schematically illustrating a subroutine periodically carried out by the control IC according to the fifth embodiment.

Next, the following describes a main routine carried out by the ECU 30 and a reverse-rotation reduction routine including the reverse-rotation reduction sequence carried out by the control IC 22 with reference to respective FIGS. 11 and 12.

First, the following describes the main routine with reference to FIG. 11.

First, the ECU 30 determines whether the engine 10 is in the idle reduction state in step S301 similar to step S102. When it is deter mined that the ECU 30 is not performing the idle reduction control task so that the engine 10 is not being in the idle reduction state (NO in step S301), the ECU 30 terminates the main routine. Otherwise, when it is determined that the ECU 30 is performing the idle reduction control task, so that the engine 10 is in the idle reduction state (YES in step S301), the ECU 30 determines whether the engine rotational speed Ne is falling in step S302. When it is determined that the engine rotational speed Ne is not falling (NO in step S302), the ECU 30 terminates the main routine. Otherwise, when it is deter mined that the engine rotational speed Ne is falling (YES in step S302), the ECU 30 sends as a trigger signal, the enabling signal to the control IC 22 to enable execution of the reverse-rotation reduction sequence in step S303. Thereafter, the ECU 30 terminates the main routine.

Next, the following describes the reverse-rotation reduction routine periodically carried out by the control IC 22 with reference to FIG. 12.

Referring to FIG. 12, the control IC 22 determines whether it has received the enabling signal from the ECU 30 in step S401. When it is determined that the control IC 22 has not received the enabling signal (NO in step S401), the control IC 22 determines that the engine 10 is not in the idle reduction state or the engine rotational speed Ne is not falling. Then, the control IC 22 terminates the reverse-rotation reduction routine.

Otherwise, when it is determined that the control IC 22 has received the enabling signal (YES in step S401), the control IC 22 determines whether it has started the reverse-rotation reduction sequence in step S402. When it is determined that the control IC 22 has not started the reverse-rotation reduction sequence (NO in step S402), the control IC 22 determines whether the engine rotational speed Ne is lower than the third threshold speed Ne3 in step S403. As describe above, the control IC 22 calculates the engine rotational speed Ne based on the induced electromotive force measured by the rotation parameter detector 23.

When it is determined that the engine rotational speed Ne is equal to or higher than the third threshold speed Ne3 (NO in step S403), the control IC 22 terminates the reverse-rotation reduction routine.

Otherwise, when it is determined that the engine rotational speed Ne is lower than the third threshold speed Ne3 (YES in step S403), the control IC 22 starts the reverse-rotation reduction sequence in step S404. That is, in step S404, the control IC 22 controls the driver 24 to drive the alternator 21 such that the quantity of decrease of the engine rotational speed Ne per unit time matches with the predetermined quantity. This prevents abrupt decrease of the engine rotational speed Ne to thereby prevent reverse rotation of the rotating shaft 13 of the engine 10. Note that the third threshold speed Ne3 is set to be lower than the idle speed, because the reverse-rotation reduction sequence is carried out while the ECU 30 is performing the idle reduction control task. The operations in step S401 to S403 serve as a starting condition of the reverse-rotation reduction sequence.

Otherwise, when affirmative determination is carried out in step S402, i.e. when the control IC 22 determines that it has carried out the operation in step S404, so that the reverse-rotation reduction sequence has been started (YES in step S402), the reverse-rotation reduction routine proceeds to step S405. In step S405, the control IC 22 determines whether it has been performing the rotational-speed maintenance sequence.

When it is determined that the control IC 22 has not been performing the rotational-speed maintenance sequence (NO in step S405), the control IC 22 determines whether the engine rotational speed Ne is higher than the fourth threshold speed Ne4 in step S406. When it is determined that the engine rotational speed Ne is higher than the fourth threshold speed Ne4 (YES in step S406), the control IC 22 controls the driver 24 to gradually reduce the engine rotational speed Ne in step S407. Thereafter, the control IC 22 terminates the reverse-rotation reduction routine.

Otherwise, when it is determined that the engine rotational speed Ne is equal to or lower than the fourth threshold speed Ne4 (NO in step S406), the control IC 22 starts the rotational-speed maintenance sequence set forth above to maintain the engine rotational speed Ne at the fourth threshold speed Ne4 or thereabout in step S408. Thereafter, the control IC 22 terminates the reverse-rotation reduction routine. Note that the fourth threshold speed Ne 4 is determined such that, if the alternator 21 is deactivated while the engine rotational speed Ne is maintained at the fourth threshold speed Ne4, the rotating shaft 13 of the engine 10 is prevented from rotating in the reverse direction.

Otherwise, when it is determined that the control IC 22 has been performing the rotational-speed maintenance sequence (YES in step S405), the control IC 22 determines whether the predetermined period has elapsed since the start of the rotational-speed maintenance sequence in step S409.

Upon determining that the predetermined period has not elapsed since the start of the rotational-speed maintenance sequence (NO in step S409), the control IC 22 continuously performs the rotational-speed maintenance sequence to maintain the engine rotational speed Ne at the fourth threshold speed Ne4 or thereabout in step S410. Thereafter, the control IC 22 terminates the reverse-rotation reduction routine.

Otherwise, upon determining that the predetermined period has elapsed since the start of the rotational-speed maintenance sequence (YES in step S409), the control IC 22 terminates the rotational-speed maintenance sequence in step S411, and thereafter, terminates the reverse-rotation reduction routine.

The above engine starting system according to the fifth embodiment achieves the following advantageous effects in addition to the advantageous effects achieved by the engine starting system according to the first embodiment.

The larger the quantity of decrease of the engine rotational speed Ne per unit time is, the larger inertial energy of the rotating shaft 13 is during the idle reduction control task. This would result in a large quantity of rotation of the rotating shaft 13 in the reverse direction after the engine rotational speed Ne becomes zero. Large torque would be required to start the engine 10 while its rotating shaft 13 is rotating in the reverse direction. For this reason, there are first and second ideas for starting the engine 10 while its rotating shaft 13 is rotating in the reverse direction. The first idea is to use, as the starter motor 13, a starter motor capable of generating larger torque, and the second idea is to start the engine 10 after the reverse rotation of the engine 10 is ended.

Unfortunately, the engine starting system designed based on the first idea would have higher manufacturing cost and result in more wearing of the pinon gear and ring gear. The second idea would have a loner starting time until the starting of the engine 10 is completed.

In contrast, the engine starting system according to the fifth embodiment performs the reverse-rotation reduction sequence before stop of the engine 10, thus enabling rotation of the rotating shaft 13 of the engine 10 to be stopped while the engine rotational speed Ne is sufficiently reduced.

The engine starting system according to the fifth embodiment is also configured to perform the rotational-speed maintenance sequence to maintain the engine rotational speed Ne4 at the fourth threshold speed Ne4, and thereafter reduce the engine rotational speed Ne4 to zero. This results in smaller inertial energy of the rotating shaft 13 when the engine rotational speed Ne becomes zero, resulting in a smaller quantity of rotation of the rotating shaft 13 in the reverse direction.

The lower the engine rotational speed Ne is, the lower the measurement accuracy of the engine rotational speed Ne by the rotational speed sensor 45 is.

From this viewpoint, the engine starting system according to the fifth embodiment is configured to obtain the engine rotational speed Ne based on the electromotive force induced based on rotation of the alternator 21; the induced electromotive force is continuously measured by the rotation parameter detector 23. Because the rotational speed of the alternator 21 is higher by the speed reduction ratio of the power transfer mechanism 16 than the engine rotational speed Ne, the control IC 22 obtains the engine rotational speed Ne with higher resolution than the rotational speed sensor 45. This enables the control IC 22 to obtain the engine rotational speed N with higher accuracy just before stop of the engine 10, and to perform the reverse-rotation reduction sequence just before stop of the engine 10. This results in (1) The engine starting system according to the fifth embodiment having lower manufacturing cost (2) Less wear of the pinon 12 and ring gear 14

(3) Shorter time until restart of the engine 10.

Sixth Embodiment

The following describes an engine starting system according to the sixth embodiment of the present disclosure. The structure and/or functions of the engine starting system according to the sixth embodiment differ from the engine starting system according to the fifth embodiment in the following points. So, the following mainly describes the different points.

The reverse-rotation reduction routine according to the sixth embodiment is slightly different from the reverse-rotation reduction routine according to the fifth embodiment.

Figure 13:
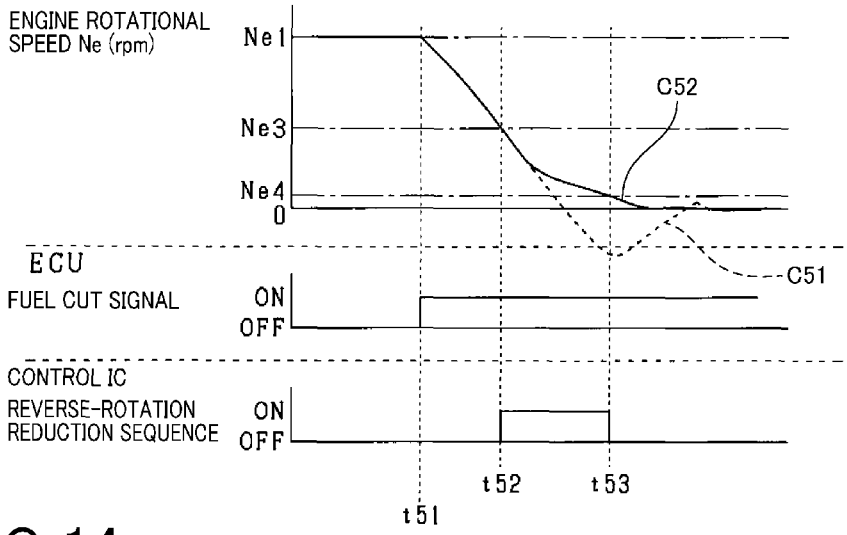
FIG. 13 is a timing chart schematically illustrating an engine starting process carried out by the ECU and the control IC according to the sixth embodiment of the present disclosure.

The following describes the reverse-rotation reduction sequence according to the sixth embodiment with reference to the timing chart illustrated in FIG. 13. The dashed curve C51 of FIG. 13 illustrates how the engine rotational speed Ne would change if the reverse-rotation reduction sequence were not carried out.

At time t51, the ECU 30 generates the fuel cut signal in response to detection of the driver's depression of the brake pedal 43 while the travelling speed of the vehicle V is equal to or lower than the predetermined speed. This starts to perform the idle reduction control task, causing the engine rotational speed Ne to fall in the same manner as the fifth embodiment. At that time, the ECU 30 sends the enabling signal to enable execution of the reverse-rotation reduction sequence to the control IC 22 (see steps S301 to S303).

When receiving the enabling signal (YES in step S401), the control 22 determines whether the engine rotational speed Ne has fallen to be lower than the third threshold speed Ne3 (see step S403). Then, the control IC 22 starts to perform the reverse-rotation reduction sequence when the engine rotational speed Ne has fallen to be lower than the third threshold speed Ne3 (see step S404) at time t52. That is, the control IC 22 performs the reverse-rotation reduction sequence to control the driver 24 to drive the alternator 21 such that the quantity of decrease of the engine rotational speed Ne per unit time matches with the predetermined quantity (see solid curve C52 in FIG. 13).

In particular, the control IC 22 determines whether the engine rotational speed Ne is lower than the fourth threshold speed Ne4 (see step S403*a* illustrated by the two-dot chain block in FIG. 12). When the engine rotational speed Ne is equal to or higher than the fourth threshold speed Ne4 (NO in step S403*a*), the control IC 22 terminates the reverse-rotation reduction routine while continuously performing the reverse-rotation reduction sequence.

Otherwise, when the engine rotational speed Ne continuously falls down to the fourth threshold speed Ne4 at time t53 (YES in step S403*a*), the control IC 22 determines that a termination condition of the reverse-rotation reduction sequence is satisfied. Then, the control IC 22 terminates the rotational-speed maintenance routine (see step S411) without performing the rotational-speed maintenance task at the time t53.

Note that the control IC 22 can determine whether the engine rotational speed Ne has reached zero in step S403*a*. When the engine rotational speed Ne has not reached zero (NO in step S403*a*), the control IC 22 can terminate the reverse-rotation reduction routine while continuously performing the reverse-rotation reduction sequence.

Otherwise, when the engine rotational speed Ne have reached zero as the termination condition of the reverse-rotation reduction routine (YES in step S403*a*), the control IC 22 can terminate the rotational-speed maintenance routine (see step S411) without performing the rotational-speed maintenance sequence.

As described above, the engine starting system according to the sixth embodiment performs the reverse-rotation reduction sequence before stop of the engine 10, thus enabling rotation of the rotating shaft 13 of the engine 10 to be stopped while the engine rotational speed Ne is sufficiently reduced. This similarly achieves the advantageous effects achieved by the engine starting system according to the fifth embodiment except for the advantageous effect based on the rotational-speed maintenance sequence.

Seventh Embodiment

The following describes an engine starting system according to the seventh embodiment of the present disclosure. The structure and/or functions of the engine starting system according to the seventh embodiment differ from the engine starting system according to the first embodiment in the following points. So, the following mainly describes the different points.

The engine starting system according to the seventh embodiment is configured such that the engine starting process of the seventh embodiment is partly different from the engine starting process of the first embodiment.

Specifically, the engine starting process of the seventh embodiment is configured such that the main routine and the subroutine of the seventh embodiment are slightly different from the main routine and the subroutine of the sixth embodiment.

Specifically, the main routine is configured to perform (1) The main routine according to the first embodiment (2) The main routine according to the sixth embodiment.

The subroutine according to the seventh embodiment is therefore configured to perform (1) The reverse-rotation reduction sequence according to the sixth embodiment (2) The engine starting sequence according to the first embodiment.

Figure 14:
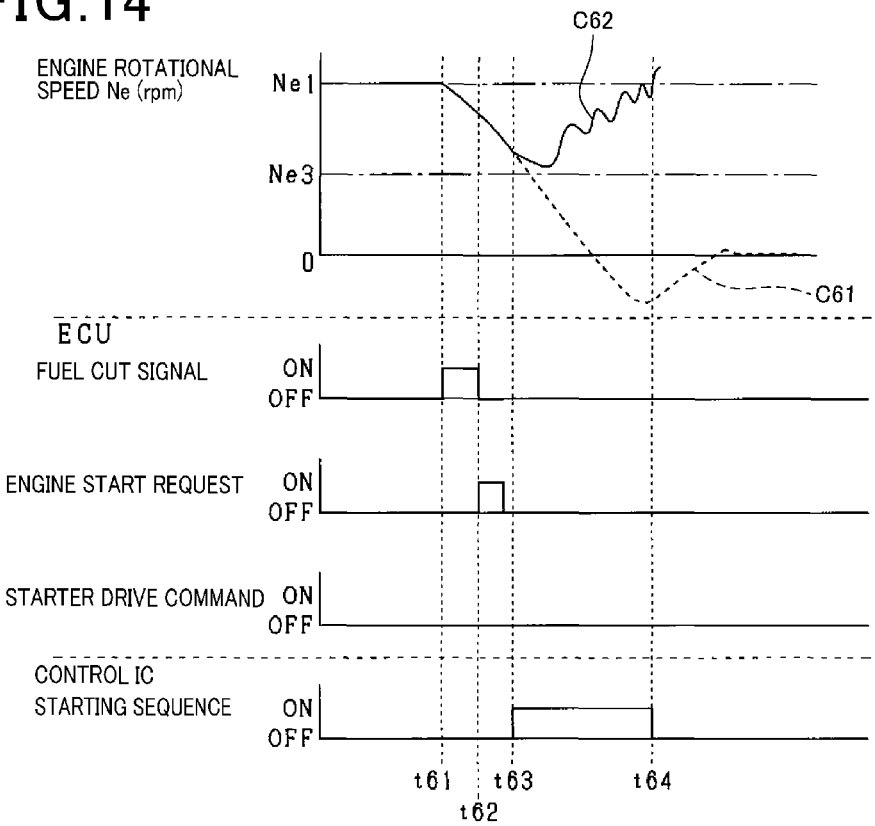
FIG. 14 is a timing chart schematically illustrating one example of an engine starting process carried out by the ECU and the control IC according to the seventh embodiment of the present disclosure.

The following describes the main routine and the subroutine without including the reverse-rotation reduction routine according to a first example of the seventh embodiment with reference to the timing chart illustrated in FIG. 14. The dashed curve C61 of FIG. 14 illustrates how the engine rotational speed Ne would change if the main routine and the subroutine without including the reverse-rotation reduction routine according to the first example of the seventh embodiment were not carried out.

At time t61, the ECU 30 turns on the fuel cut signal in response to detection of the driver's depression of the brake pedal 43 while the travelling speed of the vehicle V is equal to or lower than the predetermined speed. This starts to perform the idle reduction control task, causing the engine rotational speed Ne to fall in the same manner as the sixth embodiment.

Thereafter, a driver of the vehicle V inputs the engine start request to the ECU 30 at time t62. At that time, the ECU 30 turns off the fuel cut signal, and sends the engine start request to the control IC 22.

In response to the engine start request, the control IC 22 obtains the induced electromotive force measured by the rotation parameter detector 23, thus calculating the rotational speed of the alternator 21. Then, the control IC 22 calculates the engine rotational speed Ne based on the rotational speed of the alternator 21 and the speed reduction ratio of the power transfer mechanism 16.

After calculation of the engine rotational speed Ne, the control IC 22 starts the engine starting sequence at time t63 (see steps S201 and S202). In particular, the control IC 22 performs the engine starting sequence such that the rotational speed of the alternator 21 is substantially identical to the engine rotational speed Ne at the time t63. That is, the control IC 22 causes the alternator 21 to rotate to thereby generate torque, thus transferring the torque to the rotating shaft 13 of the engine 10 through the power transfer mechanism 16. This causes the engine rotational speed Ne to rise.

Thereafter, the ECU 30 starts the combustion task T1 set forth above. Thereafter, torque generated by the alternator 21 and the combustion task T1 cause the engine rotational speed Ne to gradually rise while the engine rotational speed Ne pulsates (see solid curve C62).

When the engine rotational speed Ne exceeds the first threshold speed Ne1 at time t64, the control IC 22 terminates the engine starting sequence (see steps S203 and S205).

In particular, the engine starting system according to the seventh embodiment uses, as the motor-generator apparatus 20, a motor-generator apparatus having a maximum rotational speed that enables the engine rotational speed Ne to rise to exceed the first threshold speed Ne1.

The engine starting system according to the first example of the seventh embodiment is configured to apply initial torque based on the alternator 21 to the rotating shaft 13 of the engine 10 without using the starter motor 11. As a second example, the engine starting system is configured to (1) Drive the starter motor 11 to apply initial torque based on the starter motor 11 to the rotating shaft 13 of the engine 10 when the engine rotational speed Ne has sufficiently fallen (2) Increase the engine rotational speed Ne based on the alternator 21 after the driving of the starter motor 11.

Figure 15:
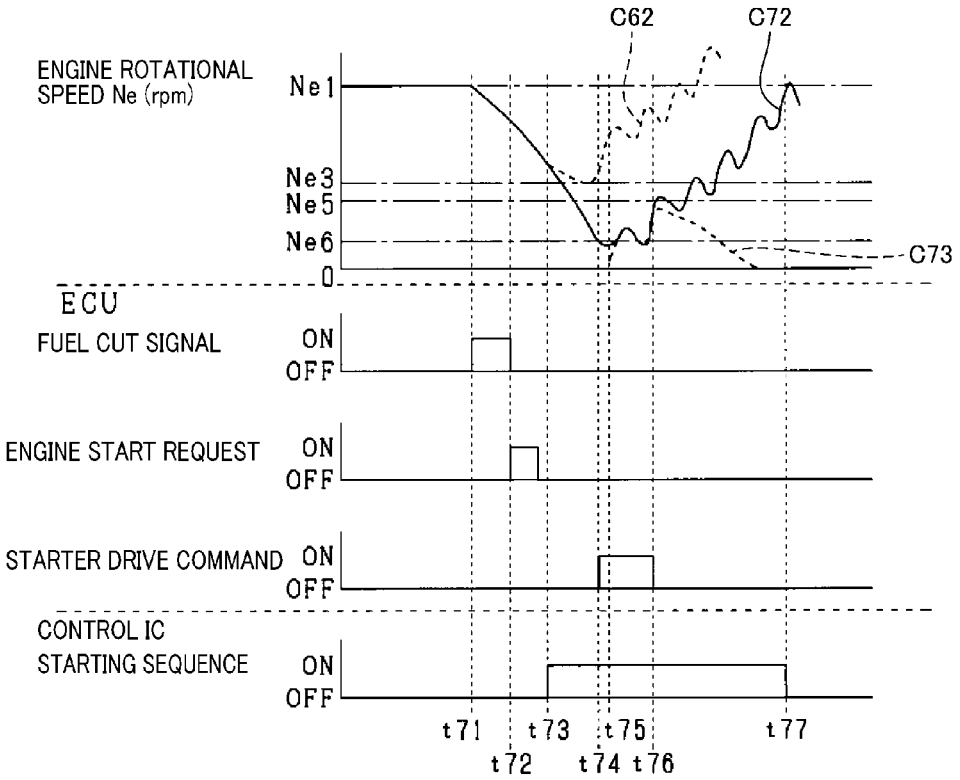
FIG. 15 is a timing chart schematically illustrating another example of the engine starting process carried out by the ECU and the control IC according to the seventh embodiment of the present disclosure.

The following describes the main routine and the subroutine without including the reverse-rotation reduction sequence according to the second example of the seventh embodiment with reference to the timing chart illustrated in FIG. 15.

At time t71, the ECU 30 turns on the fuel cut signal in response to detection of the driver's depression of the brake pedal 43 while the travelling speed of the vehicle V is equal to or lower than the predetermined speed. This starts to perform the idle reduction control task, causing the engine rotational speed Ne to fall in the same manner as the sixth embodiment.

Thereafter, a driver of the vehicle V inputs the engine start request to the ECU 30 at time t72. At that time, the ECU 30 turns off the fuel cut signal, and sends the engine start request to the control IC 22.

In response to the engine start request, the control IC 22 obtains the induced electromotive force measured by the rotation parameter detector 23, thus calculating the rotational speed of the alternator 21. Then, the control IC 22 calculates the engine rotational speed Ne based on the rotational speed of the alternator 21 and the speed reduction ratio of the power transfer mechanism 16.

After calculation of the engine rotational speed Ne, the control IC 22 starts the engine starting sequence at time t73 (see steps S201 and S202). In particular, the control IC 22 performs the engine starting sequence such that the rotational speed of the alternator 21 is substantially identical to the engine rotational speed Ne at the time t63. That is, the control IC 22 causes the alternator 21 to rotate to thereby generate torque, thus transferring the torque to the rotating shaft 13 of the engine 10 through the power transfer mechanism 16. This causes the engine rotational speed Ne to rise.

At that time, if the torque generated by the alternator 21 is insufficient to increase the engine rotational speed Ne, it is difficult to increase the engine rotational speed Ne, resulting in the engine rotational speed Ne continuously falling (see solid curve C72 as compared with dashed curve C62). When determining, based on the measurement signal sent from the rotational speed sensor 45, that the engine rotational speed Ne becomes lower than a sixth threshold speed Ne6, which serves as, for example, a predetermined reference value, at time t74, the ECU 30 turns on the starter-motor drive command, thus turning on the relay 33 at the time t74 (see step S104). This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on at time t75. This starts DC power supply to the starter motor 11. When the starter motor 11 is activated based on the supplied DC power, rotational power of the starter motor 11 is transferred to the rotating shaft 13 of the engine 10, resulting in the engine rotational speed Ne rising.

When the engine rotational speed Ne becomes to be higher than a fifth threshold speed Ne5 at time t76, the ECU 30 turns off the starter-motor drive command at the time t76. This causes the switch 32 and the relay 33 to be turned off. That is, the pinon 12 is disengaged from the ring gear 14, and the starter motor 11 is deenergized at the time t76. This results in the rotational speed of the starter motor 11 gradually falling (see dashed curve C73 in FIG. 15).

Before or after the stop of the starter motor 11, the ECU 30 starts the combustion task T1 set forth above. Torque generated by the alternator 21 and the combustion task T1 cause the engine rotational speed Ne to gradually rise while the engine rotational speed Ne pulsates (see solid curve C72).

When the engine rotational speed Ne exceeds the first threshold speed Ne1 at time t77, the control IC 22 terminates the engine starting sequence (see steps S203 and S205).

Note that, if the engine starting process illustrated in the timing chart of FIG. 15 failed to restart the engine 10, the engine starting system can be configured to restart the engine 10 in accordance with the engine starting process illustrated in the timing chart of FIG. 5 or the timing chart of FIG. 6.

Figure 16:
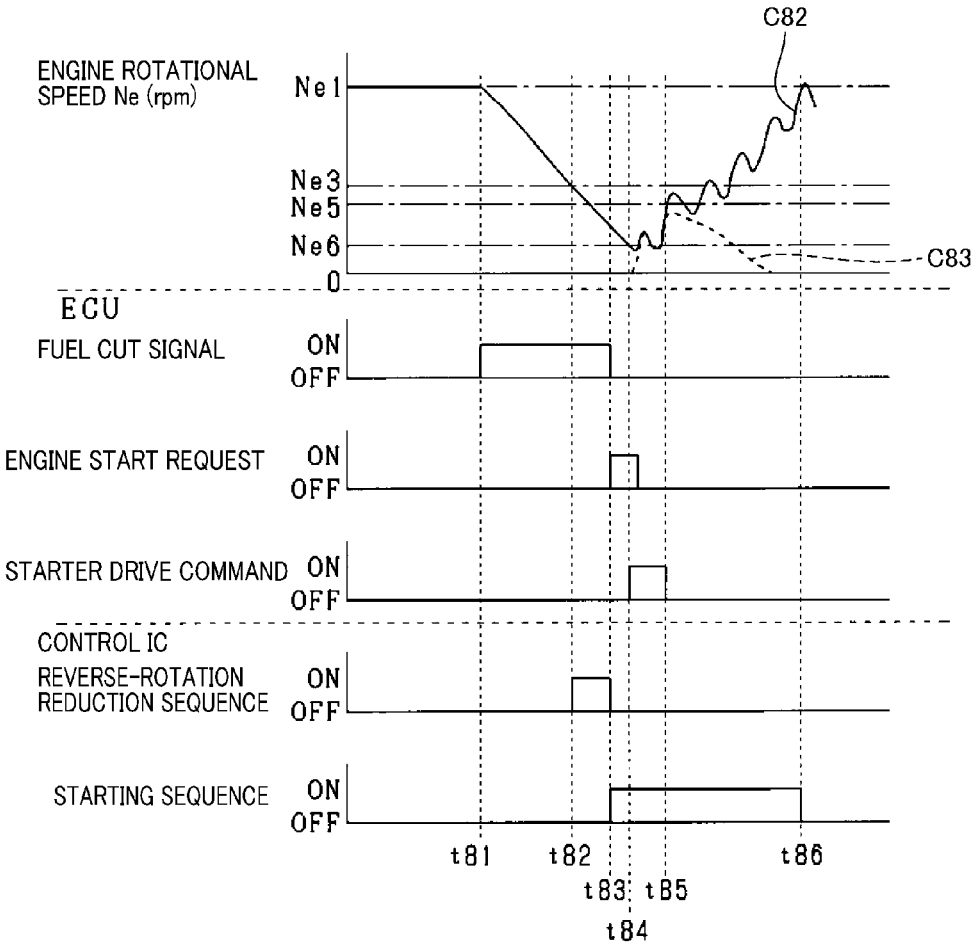
FIG. 16 is a timing chart schematically illustrating a further example of the engine starting process carried out by the ECU and the control IC according to the seventh embodiment of the present disclosure.

Next, the following describes the main routine and the subroutine according to the seventh embodiment when the engine start request is input to the ECU 30 while the reverse-rotation reduction routine is carried out with reference to the timing chart illustrated in FIG. 16.

At time t81, the ECU 30 turns on the fuel cut signal in response to detection of the driver's depression of the brake pedal 43 while the travelling speed of the vehicle V is equal to or lower than the predetermined speed. This starts to perform the idle reduction control task, causing the engine rotational speed Ne to fall in the same manner as the sixth embodiment.

At that time, the ECU 30 sends the enabling signal to enable execution of the reverse-rotation reduction sequence to the control IC 22 at the time t81.

Thereafter, when receiving the enabling signal, the control IC 22 obtains the engine rotational speed Ne based on the rotational speed of the alternator 21 and the predetermined speed reduction ratio of the power transfer mechanism 16. Then, the control IC 22 determines whether the engine rotational speed Ne has fallen to be lower than the third threshold speed Ne3, and starts to perform the reverse-rotation reduction sequence when the engine rotational speed Ne has fallen to be lower than the third threshold speed Ne3 at time t82 in the same manner as the sixth embodiment.

Thereafter, when a driver of the vehicle V inputs the engine start request to the ECU 30 at time t83, the ECU 30 turns off the fuel cut signal, and sends the engine start request to the control IC 22.

In response to the engine start request, the control IC 22 obtains the induced electromotive force measured by the rotation parameter detector 23, thus calculating the rotational speed of the alternator 21 based on the induced electromotive force. Then, the control IC 22 calculates the engine rotational speed Ne based on the rotational speed of the alternator 21 and the speed reduction ratio of the power transfer mechanism 16.

After calculation of the engine rotational speed Ne, the control IC 22 starts the engine starting sequence at time t83 (see steps S201 and S202). In particular, the control IC 22 performs the engine starting sequence such that the rotational speed of the alternator 21 is substantially identical to the engine rotational speed Ne at the time t83. That is, the control IC 22 causes the alternator 21 to rotate to thereby generate torque, thus transferring the torque to the rotating shaft 13 of the engine 10 through the power transfer mechanism 16. This causes the engine rotational speed Ne to rise.

At that time, if the torque generated by the alternator 21 is insufficient to increase the engine rotational speed Ne, it is difficult to increase the engine rotational speed Ne, resulting in the engine rotational speed Ne continuously falling (see solid curve C82). When determining, based on the measurement signal sent from the rotational speed sensor 45, that the engine rotational speed Ne becomes to be lower than the sixth threshold speed Ne6 at time t84, the ECU 30 turns on the starter-motor drive command, thus turning on the relay 33 at the time t84. This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on. This starts DC power being supplied to the starter motor 11. When the starter motor 11 is activated based on the supplied DC power, rotational power of the starter motor 11 is transferred to the rotating shaft 13 of the engine 10, resulting in the engine rotational speed Ne rising.

When the engine rotational speed Ne becomes to be higher than the fifth threshold speed Ne5 at time t85, the ECU 30 turns off the starter-motor drive command at the time t85. This causes the switch 32 and the relay 33 to be turned off. That is, the pinon 12 is disengaged from the ring gear 14, and the starter motor 11 is deenergized at the time t85. This results in the rotational speed of the starter motor 11 gradually falling (see dashed curve C83 in FIG. 16).

Before or after the stop of the starter motor 11, the ECU 30 starts the combustion task T1 set forth above. Torque generated by the alternator 21 and the combustion task T1 cause the engine rotational speed Ne to gradually rise while the engine rotational speed Ne pulsates (see solid curve C82).

When the engine rotational speed Ne exceeds the first threshold speed Ne1 at time t86, the control IC 22 terminates the engine starting sequence.

Figure 17:
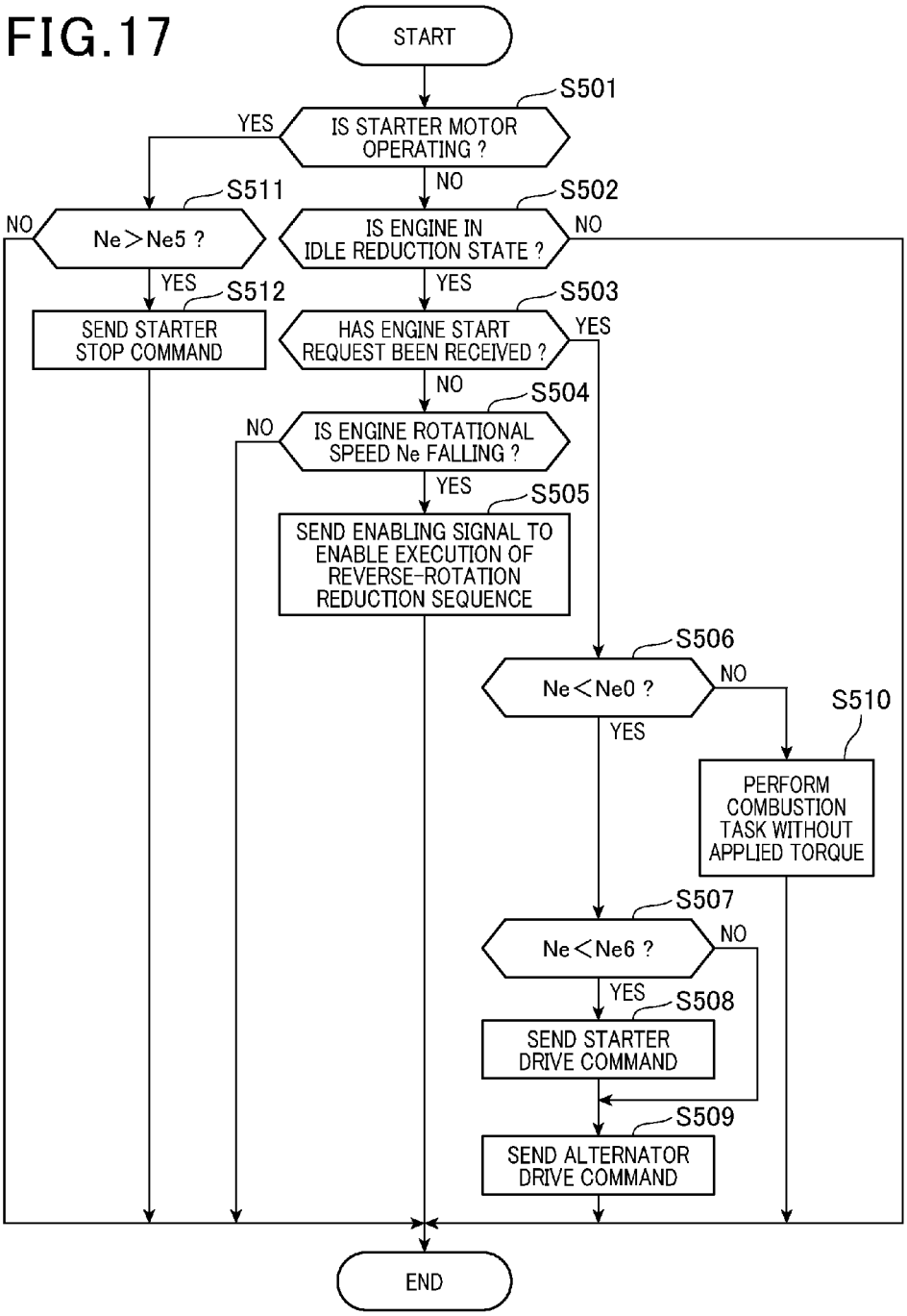
FIG. 17 is a flowchart schematically illustrating a main routine periodically carried out by the ECU according to the seventh embodiment.

The following describes main routine periodically carried out by the ECU 30 with reference to FIG. 17

First, the ECU 30 determines the starter motor 11 is operating in step S501. Specifically, the ECU 30 determines whether it has generated the starter-motor drive command in step S501.

When it is determined that the starter motor 11 is not operating (NO in step S501), the ECU 30 determines whether the engine 10 is being in the idle reduction state in step S502.

When it is determined that the ECU 30 is not performing the idle reduction control task so that the engine 10 is not being in the idle reduction state (NO in step S502), the ECU 30 terminates the main routine, because the engine 10 is operating based on the combustion task T1.

Otherwise, when it is determined that the ECU 30 is performing the idle reduction control task, so that the engine 10 is being in the idle reduction state (YES in step S502), the ECU 30 determines whether the engine start request has been received from a driver of the vehicle V in step S503.

When it is determined that the engine start request has not been received from a driver of the vehicle V (NO in step S503), the main routine proceeds to step S504. In step S504, the ECU 30 deter mines whether the engine rotational speed Ne is falling in step S504. When it is determined that the engine rotational speed Ne is not falling (NO in step S504), the ECU 30 terminates the main routine. Otherwise, when it is determined that the engine rotational speed Ne is falling (YES in step S504), the ECU 30 sends as a trigger signal, the enabling signal to the control IC 22 to enable execution of the reverse-rotation reduction sequence in step S505. Thereafter, the ECU 30 terminates the main routine.

Otherwise, when it is determined that the engine start request has been received from a driver of the vehicle V (YES in step S503), the ECU 30 determines whether the engine rotational speed Ne is lower than a predetermined fire-up speed Ne0 in step S506. The fire-up speed Ne0 represents a value of the engine rotational speed Ne at which the combustion task T1 without applied torque from the starter motor 11 or the alternator 21 enables the engine 10 to be started.

When it is determined that the engine rotational speed Ne is lower than the fire-up speed Ne0 (YES in step S506), the ECU 30 determines whether the engine rotational speed Ne is lower than the sixth threshold speed Ne6 in step S507.

Upon determining that the engine rotational speed Ne is lower than the sixth threshold speed Ne6 (YES in step S507), the ECU 30 determines that it is difficult for only the alternator 21 to restart the engine 10, because of the engine rotational speed Ne being excessively low. In contrast, when it is determined that the engine rotational speed Ne is lower than the sixth threshold speed Ne6 (YES in step S507), the difference between the rotational speed of the pinion 12 and the rotational speed of the ring gear 14 is sufficiently small. For this reason, noise and wearing of the gears 12 and 14, which is generated by engagement of the pinion 12 with the ring gear 14, are likely to be small.

Thus, the ECU 30 generates the starter-motor drive command, and sends the starter-motor drive command to the relay 33 in step S508. This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on. This starts DC power being supplied to the starter motor 11. Following the operation in step S508, the ECU 30 generates the alternator drive command, and sends the alternator drive command to the control IC 22 in step S509. When receiving the alternator drive command, the control IC 22 starts the engine starting sequence, thus applying torque generated by the alternator 21 to the rotating shaft 13 of the engine 10 through the power transfer mechanism 16 set forth above. Thereafter, the ECU 30 terminates the main routine.

Otherwise, upon determining that the engine rotational speed Ne is equal to or higher than the sixth threshold speed Ne6 (NO in step S507), the ECU 30 performs the operation in step S509 while skipping the operation in step S508. This is because the present engine rotational speed Ne enables only the alternator 21 to restart the engine 10. Thereafter, the ECU 30 terminates the main routine.

Otherwise, when it is determined that the engine rotational speed Ne is equal to or higher than the fire-up speed Ne0 (NO in step S506), the ECU 30 determines that the combustion task T1 can start the engine 10 without applied torque from the starter motor 11 or the alternator 21. Then, the ECU 30 performs the combustion task T1 without applied torque from the starter motor 11 or the alternator 21, thus restarting the engine 10 in step S510. Thereafter, the ECU 30 terminates the main routine.

On the other hand, when it is determined that the starter motor 11 is operating (YES in step S501), the ECU 30 determines whether the engine rotational speed Ne is higher than the fifth threshold speed Ne5 in step S511. Upon determining that the engine rotational speed Ne is higher than the fifth threshold speed Ne5 (YES in step S511), the ECU 30 determines that the engine rotational speed Ne has sufficiently increased to enable the alternator 20 to start the engine 10. Thus, the ECU 30 turns off the starter-motor drive command, thus turning off the switch 32 and relay 33 in step S512. This results in the starter motor 11 being deactivated. Thereafter, the ECU 30 terminates the main routine. Otherwise, upon determining that the engine rotational speed Ne is equal to or lower than the fifth threshold speed Ne5 (NO in step S511), the ECU 30 determines that it is difficult for only the alternator 21 to start the engine 10. This is because the present engine rotational speed Ne is insufficient for only the alternator 21 to start the engine 10. Thus, the ECU 30 terminates the main routine without executing the operation in step S512, thus continuing rotation of the starter motor 11.

Figure 18:
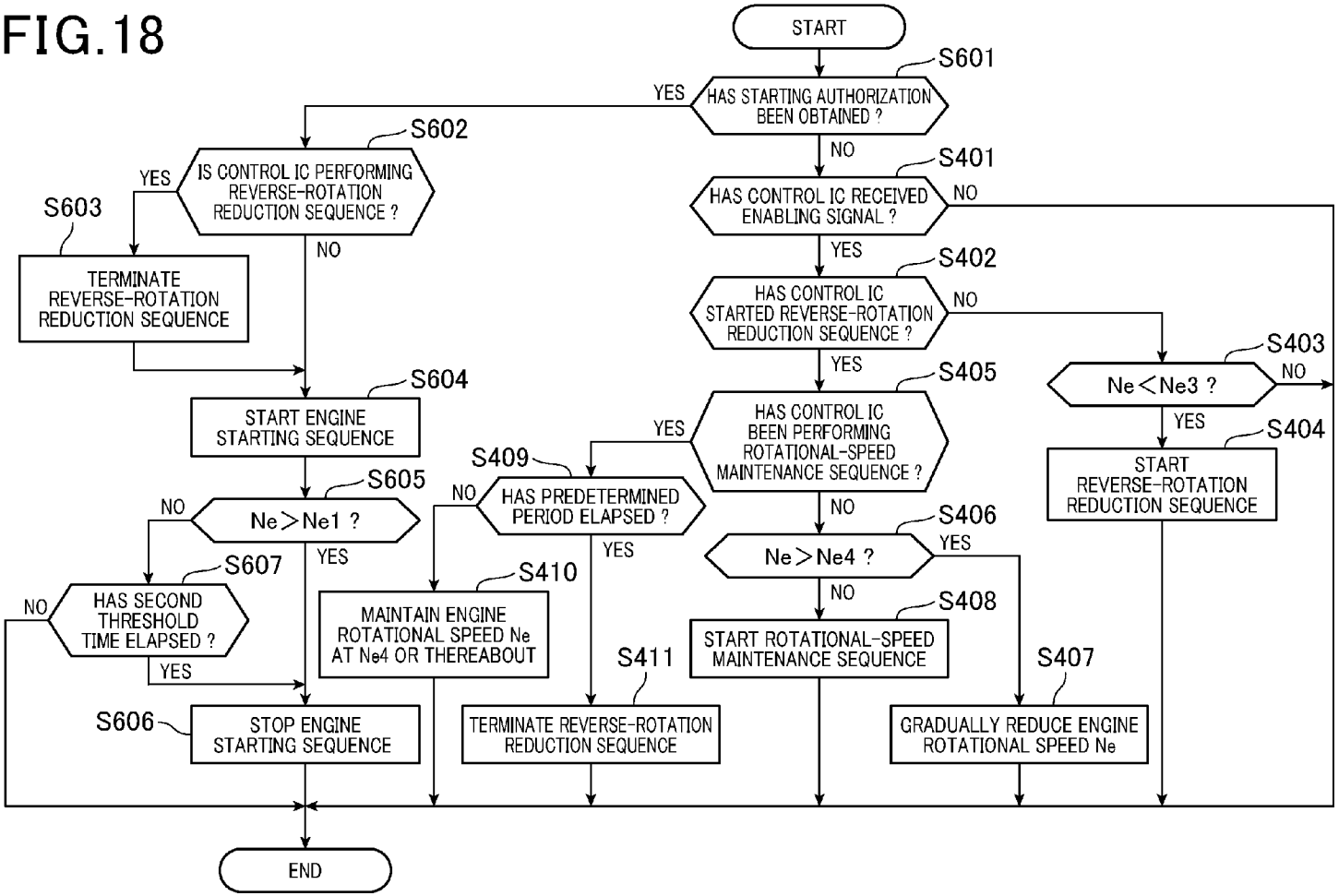
FIG. 18 is a flowchart schematically illustrating a subroutine periodically carried out by the control IC according to the seventh embodiment.

Next, the following describes the subroutine periodically carried out by the control IC 22 with reference to FIG. 18.

In step S601, the control IC 22 determines whether it has received the alternator drive command from the ECU 30 so that starting authorization has been obtained. When it is determined that starting authorization has not been obtained (NO in step S601), the control IC 22 determines whether it has received the enabling signal from the ECU 30 in step S401. Because the operations after the operation in step S401 are identical to the operations S402 to S411 illustrated in FIG. 12 of the fifth embodiment, detailed descriptions of which are omitted.

Otherwise, when it is determined that starting authorization has been obtained (YES in step S601), the control IC 22 determines whether it is performing the reverse-rotation reduction sequence in step S602. When it is determined that the control IC 22 is performing the reverse-rotation reduction sequence (YES in step S602), the control IC 22 terminates the reverse-rotation reduction sequence in step S603. Then, the subroutine proceeds to step S604. Otherwise, when it is determined that the control IC 22 is not performing the reverse-rotation reduction sequence (NO in step S602), the subroutine proceeds to step S604.

In step S604, the control IC 22 controls the driver 24 to start the engine starting sequence set forth above.

Specifically, in step S604, the control IC 22 causes the driver 24 to apply the three-phase AC power to the three-phase stator coils, thus generating the rotating magnetic field. The rotating magnetic field rotates the rotor, that is, generates torque of the rotor, based on the interactions with respect to the magnetic field generated in the rotor. The generated torque is transferred from the alternator 21 to the rotating shaft 13 of the engine 10 through the power transfer mechanism 16. This results in the engine rotational speed Ne gradually increasing. In step S604, the control IC 22 also counts time from the starting of the engine starting sequence.

Following the operation in step S604, the control IC 22 determines whether the engine rotational speed Ne is higher than the first threshold speed Ne1 in step S605.

When it is determined that the engine rotational speed Ne is higher than the first threshold speed Ne1 (YES in step S605), the control IC 22 stops the engine starting sequence and withdraws the starting permission in step S606. After the operation in step S606, the control IC 22 terminates the subroutine.

Otherwise, when it is determined that the engine rotational speed Ne is equal to or lower than the first threshold speed Ne1 (NO in step S605), the control IC 22 determines whether the counted time has reached the second threshold time in step S607. When it is determined that the counted time has not reached the second threshold time (NO in step S607), the control IC 22 terminates the subroutine without withdrawing the starting permission. This enables the control IC 22 to perform the engine starting sequence in the next cycle of the subroutine.

Otherwise, when it is deter mined that the counted time has reached the second threshold time (YES in step S607), the control IC 22 stops the engine starting sequence and withdraws the starting permission in step S606. Thereafter, the control IC 22 terminates the subroutine.

Note that, if the control IC 22 terminates the engine starting sequence in step S606 when having performed the affirmative determination in step S607, the engine starting system can be configured to restart the engine 10 in accordance with the engine starting process illustrated in the timing chart of FIG. 5 or the timing chart of FIG. 6.

As described above, the engine starting system according to the seventh embodiment achieves the following advantageous effect in addition to the advantageous effects achieved by both the engine starting systems according to the respective first and sixth embodiments.

Specifically, when the engine rotational speed Ne is lower than the sixth threshold speed Ne6, the engine starting system is configured to start the engine 10 using the starter motor 11 that can generate higher torque than the alternator 21.

If the engine rotational speed Ne were equal to or higher than the sixth threshold speed Ne6, noise and wearing of the gears 12 and 14, which is generated by engagement of the pinion 12 with the ring gear 14, would be large.

From this viewpoint, the engine starting system is configured to start the engine 10 using the alternator 21 without using the starter motor 11 when the engine rotational speed Ne is equal to or higher than the sixth threshold speed Ne6. This results in an engine starting system with less noise generated by engagement of the pinion 12 with the ring gear 14 and less wear of the pinion 12 due to engagement of the pinion 12 with the ring gear 14.

Eighth Embodiment

The following describes an engine starting system according to the eighth embodiment of the present disclosure. The structure and/or functions of the engine starting system according to the eighth embodiment differ from the engine starting system according to the seventh embodiment in the following points. So, the following mainly describes the different points.

The engine starting system according to the eighth embodiment is configured such that the engine starting process of the eighth embodiment is partly different from the engine starting process of the seventh embodiment.

Specifically, the control IC 22 is configured to (1) Perform both the reverse-rotation reduction sequence according to the sixth embodiment, and the engine starting sequence according to the first embodiment (2) Perform an interval setting task to maintain the alternator 21 to be deactivated when switching the reverse-rotation reduction sequence to the engine starting sequence, thus setting an interval, i.e. a predetermined wait period, between the reverse-rotation reduction sequence and the engine starting sequence.

Note that the interval for which the control IC 22 performs the interval setting task, i.e. the interval between the reverse-rotation reduction sequence and the engine starting sequence, can be set to a predetermined period. The control IC 22 can variably set a value of the interval depending on (1) The engine rotational speed Ne (2) The output voltage of the battery 31

(3) Environmental temperatures including the ambient temperature, the temperature of the engine coolant, the temperature of the control IC 22, the temperature of the driver 24, and/or the temperature of one or more control circuit boards of the control IC 22

(4) Age variations of the components of the engine 10.

This enables the control IC 22 to start the engine starting sequence before there is a malfunction in the vehicle V.

Figure 19:
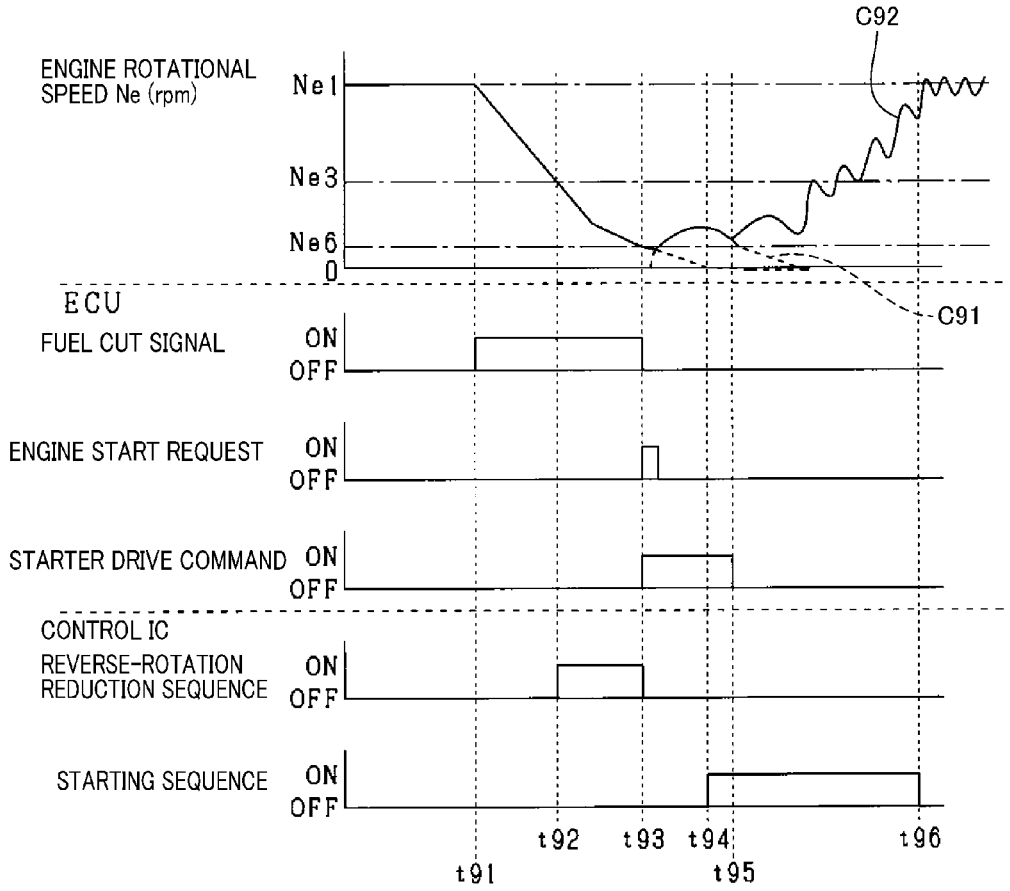
FIG. 19 is a timing chart schematically illustrating an engine starting process carried out by the ECU and the control IC according to the eighth embodiment of the present disclosure.

Next, the following describes the main routine and the subroutine according to the eighth embodiment when the engine start request is input to the ECU 30 while the reverse-rotation reduction routine is carried out with reference to the timing chart illustrated in FIG. 19.

At time t91, the ECU 30 turns on the fuel cut signal in response to detection of the driver's depression of the brake pedal 43 while the travelling speed of the vehicle V is equal to or lower than the predetermined speed. This starts to perform the idle reduction control task, causing the engine rotational speed Ne to fall in the same manner as the fifth embodiment.

At that time, the ECU 30 sends the enabling signal to enable execution of the reverse-rotation reduction sequence to the control IC 22 at the time t91.

Thereafter, when receiving the enabling signal, the control IC 22 obtains the engine rotational speed Ne based on the rotational speed of the alternator 21 and the predetermined speed reduction ratio of the power transfer mechanism 16. Then, the control IC 22 determines whether the engine rotational speed Ne has fallen to be lower than the third threshold speed Ne3, and starts to perform the reverse-rotation reduction sequence when the engine rotational speed Ne has fallen to be lower than the third threshold speed Ne3 at time t92 in the same manner as the sixth embodiment.

Thereafter, when a driver of the vehicle V inputs the engine start request to the ECU 30 at time t93, the ECU 30 turns off the fuel cut signal, and sends the engine start request to the control IC 22.

At the time t93, when determining, based on the measurement signal sent from the rotational speed sensor 45, that the engine rotational speed Ne becomes to be lower than the sixth threshold speed Ne6, the ECU 30 turns on the starter-motor drive command, thus turning on the relay 33 at the time t93. This causes the solenoid mechanism 15 to shift the pinion 12 from the predetermined initial position to the ring gear 14 so that the pinion 12 is engaged with the ring gear 14. The shifting operation of the pinion 12 to the ring gear 14 causes the switch 32 to be turned on. This starts DC power being supplied to the starter motor 11. When the starter motor 11 is activated based on the supplied DC power, rotational power of the starter motor 11 is transferred to the rotating shaft 13 of the engine 10, resulting in the engine rotational speed Ne rising.

Note that, at the time t93, when determining, based on the measurement signal sent from the rotational speed sensor 45, that the engine rotational speed Ne is equal to or higher than the sixth threshold speed Ne6, the ECU 30 waits for the engine rotational speed Ne becoming to be lower than the sixth threshold speed Ne6. Thereafter, the ECU 30 turns on the starter-motor drive command.

Additionally, in response to the engine start request, the control IC 22 terminates the reverse-rotation reduction sequence at the time t93, shifting to the interval setting task that maintains the alternator 21 to be deactivated. That is, the control IC 22 is capable of obtaining the induced electromotive force measured by the rotation parameter detector 23 because the alternator 21 is not controlled by the control IC 22. Thus, the control IC 22 is capable of calculating the rotational speed of the alternator 21 based on the induced electromotive force, thus calculating the engine rotational speed Ne based on the rotational speed of the alternator 21 and the speed reduction ratio. The control IC 22 starts the engine starting sequence including the engine starting sequence at time t94 when the predetermined interval has elapsed since the start of the interval setting task at the time t93.

On the other hand, the ECU 30 turns off, at time t95, the starter-motor drive command when a predetermined time has elapsed since the start of drive of the starter motor 11. The predetermined time from the start of drive of the starter motor 11 to the stop of drive of the starter motor 11 is previously determined based on the length of the interval of the interval setting task such that the stop timing of the starter motor 11 is later than the end timing of the interval. This prevents the starter motor 11 from being deactivated during the interval. That is, if the starter motor 11 were deactivated during the interval, only the alternator 21 would perform the engine starting sequence of the engine 10, which might have difficulty starting the engine 10. This causes the switch 32 and the relay 33 to be turned off. That is, the pinon 12 is disengaged from the ring gear 14, and the starter motor 11 is deenergized at the time t85. This results in the rotational speed of the starter motor 11 gradually falling (see dashed curve C91 in FIG. 19).

Before or after the stop of the starter motor 11, the ECU 30 starts the combustion task T1 set forth above. Torque generated by the alternator 21 and the combustion task T1 cause the engine rotational speed Ne to gradually rise while the engine rotational speed Ne pulsates (see solid curve C92).

When the engine rotational speed Ne exceeds the first threshold speed Ne1 at time t96, the control IC 22 terminates the engine starting sequence.

Figure 20:
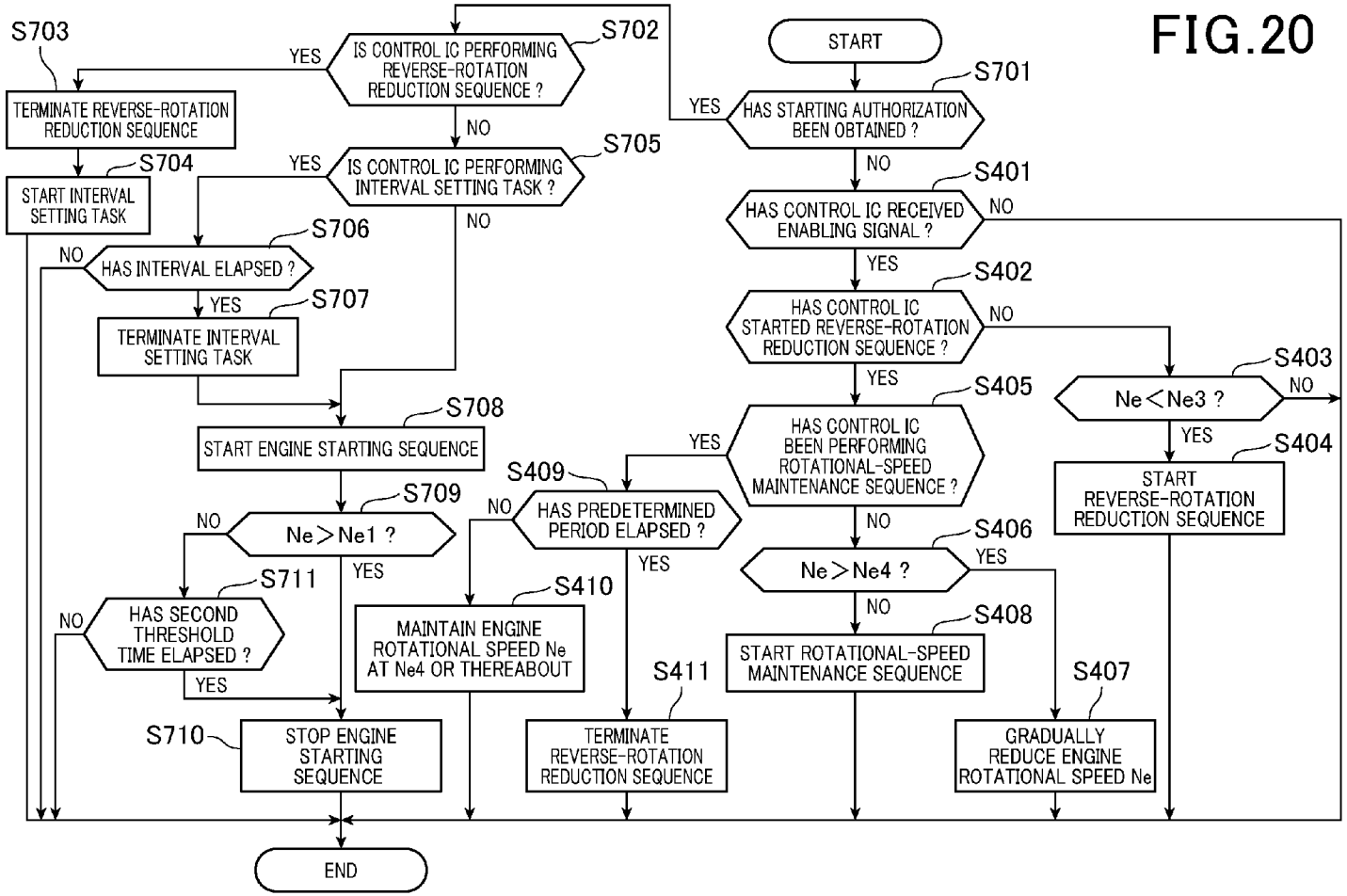
FIG. 20 is a flowchart schematically illustrating a main routine periodically carried out by the ECU according to the eighth embodiment.

The following describes the subroutine periodically carried out by the control IC 22 with reference to FIG. 20.

In step S701, the control IC 22 determines whether it has received the alternator drive command from the ECU 30 so that starting authorization has been obtained. When it is determined that starting authorization has not been obtained (NO in step S701), the control IC 22 determines whether it has received the enabling signal from the ECU 30 in step S401. Because the operations after the operation in step S401 are identical to the operations S402 to S411 illustrated in FIG. 12 of the fifth embodiment, detailed descriptions of which are omitted.

Otherwise, when it is determined that starting authorization has been obtained (YES in step S701), the control IC 22 determines whether it is performing the reverse-rotation reduction sequence in step S702. When it is determined that the control IC 22 is performing the reverse-rotation reduction sequence (YES in step S702), the control IC 22 terminates the reverse-rotation reduction sequence in step S703. Then, the subroutine proceeds to step S704, and the control IC 22 starts performing the interval setting task as described in the timing chart of FIG. 19 in step s704. That is, the control IC 22 terminates control of the alternator 21, and obtains the engine rotational speed Ne based on the induced electromotive force in step S704. After completion of the operation in step S704, the control IC 22 terminates the subroutine.

Otherwise, when it is determined that the control IC 22 is not performing the reverse-rotation reduction sequence (NO in step S702), the subroutine proceeds to step S705.

In step S705, the control IC 22 determines whether the control IC 22 is performing the interval setting task. Upon determining that the control IC 22 is performing the interval setting task (YES in step S705), the control IC 22 determines whether the interval has elapsed since the start of performing the interval setting task in step S706. As described above, the interval can be set to a predetermined value or can be variably set based on, for example, a value of the engine rotational speed Ne at the stop of the reverse-rotation reduction sequence in step S703.

Upon determining that the interval has not elapsed since the start of performing the interval setting task (NO in step S706), the control IC 22 terminates the subroutine. This enables the interval setting task to be continuously carried out.

Otherwise, upon determining that the interval has elapsed since the start of performing the interval setting task (YES in step S706), the control IC 22 terminates the interval setting task in step S707. Thereafter, the subroutine proceeds to step S708. In addition, when it is determined that the control IC 22 is not performing the interval setting task (NO in step S705), the subroutine proceeds to step S708.

In step S708, the control IC 22 controls the driver 24 to start the engine starting sequence set forth above.

Specifically, in step S708, the control IC 22 causes the driver 24 to apply the three-phase AC power to the three-phase stator coils, thus generating the rotating magnetic field. The rotating magnetic field rotates the rotor, that is, generates torque of the rotor, based on the interactions with respect to the magnetic field generated in the rotor. The generated torque is transferred from the alternator 21 to the rotating shaft 13 of the engine 10 through the power transfer mechanism 16. This results in the engine rotational speed Ne gradually increasing. In step S708, the control IC 22 also counts time from the starting of the engine starting sequence.

Following the operation in step S708, the control IC 22 determines whether the engine rotational speed Ne is higher than the first threshold speed Ne1 in step S709.

When it is determined that the engine rotational speed Ne is higher than the first threshold speed Ne1 (YES in step S709), the control IC 22 stops the engine starting sequence and withdraws the starting permission in step S710. After the operation in step S710, the control IC 22 terminates the subroutine.

Otherwise, when it is determined that the engine rotational speed Ne is equal to or lower than the first threshold speed Ne1 (NO in step S709), the control IC 22 determines whether the counted time has reached the second threshold time in step S711. When it is determined that the counted time has not reached the second threshold time (NO in step S711), the control IC 22 terminates the subroutine without withdrawing the starting permission. This enables the control IC 22 to perform the engine starting sequence in the next cycle of the subroutine.

Otherwise, when it is deter mined that the counted time has reached the second threshold time (YES in step S711), the control IC 22 stops the engine starting sequence and withdraws the starting permission in step S710. Thereafter, the control IC 22 terminates the subroutine.

Note that, if the control IC 22 terminates the engine starting sequence in step S710 when having performed the affirmative determination in step S711, the engine starting system can be configured to restart the engine 10 in accordance with the engine starting process illustrated in the timing chart of FIG. 5 or the timing chart of FIG. 6.

As described in the first embodiment, upon performing the engine starting sequence for the engine 10 having the engine rotational speed Ne of zero, the engine starting sequence has not started the reverse-rotation reduction sequence when receiving the starting authorization. Thus, the control IC 22 does not perform the affirmative determination in step S702, and therefore does not start the interval setting task in step S704. This results in the negative determination in each of steps S702 and S705, so that the control IC 22 performs the engine starting sequence in step S708.

As described above, the engine starting system according to the eighth embodiment achieves the following advantageous effects in addition to the advantageous effects achieved by both the engine starting systems according to the respective first and seventh embodiments.

Specifically, when switching the reverse-rotation reduction sequence to the engine starting sequence in response to the alternator drive command as a trigger signal, the control IC 22 is configured to perform the interval setting task to obtain the operating conditions of the engine 10 before performing the engine starting sequence. This enables the control IC 22 to obtain the operating conditions of the engine 10 at the start of the engine starting sequence with higher accuracy.

If the control IC 22 performed the engine starting sequence based on the alternator 21 simultaneously with or before the starting of the starter motor 11, torque applied to the rotating shaft 13 of the engine 10 might increase the engine rotational speed Ne. This might result in noise and wearing of the gears 12 and 14, which is generated by engagement of the pinion 12 with the ring gear 14, during an increase of the engine rotational speed Ne.

From this viewpoint, the engine starting system according to the eighth embodiment is configured to perform the interval setting task to thereby set the interval between the end timing of the reverse-rotation reduction sequence, i.e. the start timing of activation of the starter motor 11, and the start timing of the engine starting sequence based on the alternator 21. That is, the control IC 22 performs the engine starting sequence when the interval has elapsed since the start timing of activation of the starter motor 11. This prevents the engine rotational speed Ne from increasing based on the engine starting sequence at start of activating the starter motor 11. This achieves, in addition to the advantageous effects of the seventh embodiment, an advantageous effect of the engine starting system with less noise generated by engagement of the pinion 12 with the ring gear 14 and less wear of the pinion 12 due to engagement of the pinion 12 with the ring gear 14.

Modifications

The control IC 22 according to each embodiment is configured to perform, based on the engine rotational speed Ne, one of the control sequences in response to receiving a corresponding trigger signal sent from the ECU 30, but the present disclosure is not limit to this configuration.

A control IC 22 according to a first modification can be configured to perform a selected one of the control sequences in response to the occurrence of a trigger situation based on the engine rotational speed Ne; the selected one of the control sequences is linked to the generated trigger situation.

Specifically, the control IC 22 according to the first modification is configured to start the engine starting sequence in response to the occurrence of the trigger situation where the engine rotational speed Ne starts to increase from zero. This is because the increase of the engine rotational speed Ne from zero is based on activation of the alternator 21.

The control IC 22 according to the first modification is also configured to start the reverse-rotation reduction sequence in response to the occurrence of the trigger situation where the engine rotational speed Ne gradually falls to be lower than the third threshold speed Ne3. This is because a gradual decrease of the engine rotational speed Ne to be below the third threshold speed Ne3 is based on execution of the fuel cut task.

The control IC 22 according to the first modification is further configured to stop the reverse-rotation reduction sequence and thereafter start the engine starting sequence in response to the occurrence of the trigger situation where the engine rotational speed Ne starts to rising during execution of the reverse-rotation reduction sequence. This is because, for starting of the engine 10 during execution of the reverse-rotation reduction sequence, the starter motor 10 need be activated to apply torque to the rotating shaft 13 of the engine 10, so that the engine rotational speed Ne should rise. The control IC 22 according to the first modification can be configured to stop the reverse-rotation reduction sequence, perform the interval setting task, and, after the lapse of the interval set by the interval setting task, start the engine starting sequence.

The control IC 22 according to each embodiment is configured to calculate the engine rotational speed Ne using the induced electromotive force measured by the rotation parameter detector 23, but the present disclosure is not limited to this configuration.

Specifically, the starting control system according to a second modification can be configured such that the rotational speed sensor 45 is communicably connected to the control IC 22, so that the control IC 22 can obtain the engine rotational speed Ne based on the measurement signal of the engine rotational speed Ne.

The engine starting system according to each embodiment is configured to engage the pinion 12 with the ring gear 14 first, and thereafter start turning the starter motor 11, but the engine starting system can be configured to simultaneously perform (1) Engagement of the pinion 12 with the ring gear 14

(2) Start of turning the starter motor 11.

The engine starting system according to each embodiment is configured to engage the pinion 12 with the ring gear 14 first, and thereafter start of turning the starter motor 11, but the present disclosure is not limited to this configuration.

Specifically, the engine starting system according to each embodiment can be configured to start rotation of the starter motor 11 first, and engage the pinion 12 with the ring gear 14 when the engine rotational speed Ne is not to zero. This configuration reduces the difference in rotational speed between the pinion 12 and the ring gear 14, resulting in the engine starting system with less noise generated by engagement of the pinion 12 with the ring gear 14 and less wear of the pinion 12 due to engagement of the pinion 12 with the ring gear 14.

The engine starting system according to the eighth embodiment is configured to perform the interval setting task in order to delay the start of the engine starting sequence based on the alternator 21 as compared with the start of activation of the starter motor 11. If execution of the interval setting task results in the start of the engine starting task being earlier than the start of activation of the starter motor 11, the engine starting system can expand the interval for which the control IC 22 performs the interval setting task, thus reliably delaying the start of the engine starting sequence based on the alternator 21 as compared with the start of activation of the starter motor 11.

A third modification of the engine starting system according to the eighth embodiment can be configured to perform the interval setting task if not performing the reverse-rotation reduction sequence. The ECU 30 according the third modification is configured to turn on the starter-motor drive command based on the engine start request, and send the engine start request to the control IC 22 when the predetermined interval has elapsed since the start of the turn-on of the starter-motor drive command. The ECU 30 can change the interval for example depending on (1) The engine rotational speed Ne (2) The output voltage of the battery 31

(3) Environmental temperatures including the ambient temperature, the temperature of the engine coolant, the temperature of the control IC 22, the temperature of the driver 24, and/or the temperature of one or more control circuit boards of the control IC 22

(4) Age variations of the components of the engine 10.

While the illustrative embodiments of the present disclosure have been described herein, the present disclosure is not limited to the embodiments described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. A system for controlling torque applied to a rotating shaft of an engine of a vehicle that uses the engine as a drive source thereof, the system comprising:

a motor;

a main controller for controlling the engine and the motor, the main controller being configured to selectably activate the motor that applies first torque to the rotating shaft of the engine, and deactivate the motor;

a rotary electric machine comprising a rotor connected to the rotating shaft of the engine;

a rotation parameter detector configured to detect a rotation parameter associated with rotation of the rotor of the rotary electric machine; and a sequence controller configured to perform, in response to an occurrence of a trigger situation, a predetermined control sequence that controls, independently of the main controller, the rotary electric machine based on the rotation parameter detected by the rotation parameter detector to thereby apply second torque to the rotating shaft of the engine.

2. The system according to claim 1, wherein:

the motor is connectable to the rotating shaft of the engine via an engagement of first and second gears, and is configured to transfer the first torque to the rotating shaft of the engine while the first and second gears are engaged with each other; and the rotary electric machine having a maximum rotational speed of the rotor higher than a maximum rotational speed of the motor, the rotary electric machine being configured to transfer the second torque to the rotating shaft via a belt mechanism.

3. The system according to claim 1, wherein:

the control sequence includes a starting sequence that causes the rotary electric machine to apply the second torque to the rotating shaft during starting of the engine;

the main controller is configured to maintain deactivation of the motor when a rotational speed of the rotating shaft is higher than a predetermined value;

the sequence controller is configured to perform the starting sequence when the rotational speed of the rotating shaft is higher than the predetermined value;

the main controller is configured to activate the motor when the rotational speed of the rotating shaft is equal to or lower than the predetermined reference value; and the sequence controller is configured to perform the starting sequence when the rotational speed of the rotating shaft is equal to or lower than the predetermined reference value.

4. The system according to claim 3, wherein:

the starting of the engine is restarting of the engine;

the main controller is configured to activate the motor when the rotational speed of the rotating shaft is equal to or lower than the predetermined reference value; and the sequence controller is configured to perform the starting sequence when a predetermined wait period has elapsed since activation of the motor by the main controller.

5. The system according to claim 3, wherein:

the sequence controller is configured to:

terminate the starting sequence when the rotational speed of the rotating shaft has reached a predetermined threshold speed; and stop the starting sequence when the rotational speed of the rotating shaft has not reached the predetermined threshold speed for a predetermined first time since the start of the starting sequence.

6. The system according to claim 3, wherein:

the main controller is configured to:

supply fuel to the engine; and set a first timing to supply the fuel to the engine when the engine has not started for a predetermined second time since the start of the starting sequence to be earlier than a second timing to supply the fuel to the engine when the engine has started for the predetermined second time since the start of the starting sequence.

7. The system according to claim 3, wherein:

the main controller is configured to:

supply fuel to the engine; and set a first activation time for which the motor is activated when the engine has not started for a third predetermined time since the start of the starting sequence to be longer than a second activation time for which the motor is activated when the engine has started for the third predetermined time since the start of the starting sequence.

8. The system according to claim 1, wherein:

the control sequence comprises a first control sequence having a predetermined first condition and a second control sequence having a predetermined second condition;

the sequence controller is configured to:

perform, in response to the occurrence of the first condition as the trigger situation, the first control sequence;

stop control of the rotary electric machine for a predetermined period despite of the occurrence of the second condition as the trigger situation; and perform the second control sequence when the predetermined period has elapsed since the occurrence of the second condition.

9. The system according to claim 1, wherein:

the sequence controller is configured to:

generate, based on the rotational speed of the motor, a trigger signal as the occurrence of the trigger situation; and perform the control sequence in response to the generated trigger signal.

10. The system according to claim 1, wherein:

the rotary electric machine is an alternating-current rotary electric machine with plural phase coils;

the rotation parameter detector is configured to detect, as the rotation parameter, electromotive force induced in the plural phase coils; and the sequence controller is configured to obtain, based on the induced electromotive force detected by the rotation parameter detector, at least one of the rotational speed of the rotor of the alternating-current rotary electric machine and a phase of one of the plural phase coils to which the sequence controller should energize.

11. A system for controlling rotation of torque applied to a rotating shaft of an engine of a vehicle that uses the engine as a drive source thereof, and is configured to stop supply of fuel to the engine during stop of the vehicle to thereby stop fuel combustion in the engine, the system comprising:

a motor connectable to the rotating shaft of the engine via an engagement of first and second gears, the motor being configured to transfer the first torque to the rotating shaft of the engine while the first and second gears are engaged with each other;

a main controller for controlling the engine and the motor, the main controller being configured to selectably activate the motor that applies first torque to the rotating shaft of the engine while the first and second gears are engaged with each other, and deactivate the motor;

a rotary electric machine comprising a rotor connected to the rotating shaft of the engine via a belt mechanism, the rotary electric machine having a maximum rotational speed of the rotor higher than a maximum rotational speed of the motor;

a rotation parameter detector configured to measure a rotation parameter associated with rotation of the rotor of the rotary electric machine;

a driver for driving the rotary electric machine; and a sequence controller configured to perform, in response to an occurrence of a trigger situation, a control sequence after the stop of the supply of the fuel to the engine and before stop of rotation of the rotating shaft, the control sequence being configured to cause the driver to control, independently of the main controller, the rotary electric machine based on the rotation parameter measured by the rotation parameter detector to thereby apply second torque to the rotating shaft of the engine via the belt mechanism.

12. The system according to claim 11, wherein:

the control sequence is configured to maintain a rotational speed of the rotor of the rotary electric machine at a predetermined speed, and to thereafter cause the driver to stop the rotary electric machine.

13. The system according to claim 11, wherein:

the control sequence is configured to gradually reduce a rotational speed of the rotor of the rotary electric machine to prevent abrupt decrease of the rotational speed of the rotor of the rotary electric machine.

14. The system according to claim 11, wherein:

the sequence controller is configured to:

perform, in response to the occurrence of a first trigger situation that is the trigger situation, a reverse-rotation reduction sequence that is the control sequence after the stop of the supply of the fuel to the engine and before stop of rotation of the rotating shaft; and perform, in response to an occurrence of a second trigger situation, a starting sequence that controls, independently of the main controller, the rotary electric machine based on the rotation parameter measured by the rotation parameter detector to thereby apply a value of the second torque to the rotating shaft of the engine during starting of the engine; and the main controller is configured to:

receive an engine start request input thereto while the sequence controller performs the reverse-rotation reduction sequence; and start to activate, in response to the engine start request, the motor when a rotational speed of the rotating shaft has decreased below a predetermined speed.

15. The system according to claim 11, wherein:

the sequence controller is configured to:

perform, in response to the occurrence of a first trigger situation that is the trigger situation, a reverse-rotation reduction sequence that is the control sequence after the stop of the supply of the fuel to the engine and before stop of rotation of the rotating shaft; and perform, in response to an occurrence of a second trigger situation, a starting sequence that controls, independently of the main controller, the rotary electric machine based on the rotation parameter measured by the rotation parameter detector to thereby apply a value of the second torque to the rotating shaft of the engine during starting of the engine; and the main controller is configured to set a first interval between start of activation of the motor and start of the starting sequence when receiving an engine start request input thereto while the sequence controller performs the reverse-rotation reduction sequence to be longer than a second interval, the main controller being configured to set the second interval between start of activation of the motor and start of the starting sequence when receiving the engine start request input thereto while the sequence controller does not perform the reverse-rotation reduction sequence.

16. The system according to claim 11, wherein:

the control sequence comprises a first control sequence having a predetermined first condition and a second control sequence having a predetermined second condition;

the sequence controller is configured to:

perform, in response to the occurrence of the first condition as the trigger situation, the first control sequence;

stop control of the rotary electric machine for a predetermined period despite of the occurrence of the second condition as the trigger situation; and perform the control sequence when the predetermined period has elapsed since the occurrence of the second condition.

17. The system according to claim 11, wherein:

the sequence controller is configured to:

generate, based on the rotational speed of the motor, a trigger signal as the occurrence of the trigger situation; and perform the control sequence in response to the generated trigger signal.

18. The system according to claim 11, wherein:

the rotary electric machine is an alternating-current rotary electric machine with plural phase coils;

the rotation parameter detector is configured to detect, as the rotation parameter, electromotive force induced in the plural phase coils; and the sequence controller is configured to obtain, based on the induced electromotive force detected by the rotation parameter detector, at least one of the rotational speed of the rotor of the alternating-current rotary electric machine and a phase of one of the plural phase coils to which the sequence controller should energize.

* * * * *